US005561033A

United States Patent [19]

Kashi et al.

[11] Patent Number: 5,561,033

[45] **Date of Patent: *Oct. 1, 1996**

[54] SILVER HALIDE PHOTOGRAPHIC LIGHT-SENSITIVE MATERIAL

[75] Inventors: Yasuo Kashi; Hirotomo Sasaki; Hiroyuki Mifune, all of Minami-Ashigara, Japan

[73] Assignee: Fuji Photo Film, Co., Ltd., Kanagawa-ken, Japan

[ * ] Notice: The term of this patent shall not extend beyond the expiration date of Pat. No. 5,215,880.

[21] Appl. No.: 255,800

[22] Filed: Jun. 7, 1994

Related U.S. Application Data

[63] Continuation of Ser. No. 917,338, Jul. 23, 1992, abandoned.

[30] Foreign Application Priority Data

Jul. 24, 1991 [JP] Japan ..... 3-207537

[51] Int. Cl.[6] ..... G03C 1/09

[52] U.S. Cl. ..... 430/601; 430/603; 430/605

[58] Field of Search ..... 430/567, 569, 430/603, 605, 601

[56] References Cited

U.S. PATENT DOCUMENTS

| | | | |
|---|---|---|---|
| 1,574,944 | 3/1926 | Sheppard | 430/603 |
| 1,602,591 | 10/1926 | Sheppard | 430/603 |
| 1,623,499 | 4/1927 | Sheppard et al. . | |
| 4,806,461 | 2/1989 | Ikeda et al. | 430/567 |
| 4,923,794 | 5/1990 | Sasaki et al. | 430/603 |
| 5,068,173 | 11/1991 | Takehara et al. | 430/567 |
| 5,215,880 | 6/1993 | Kojima et al. | 430/600 |
| 5,273,874 | 12/1993 | Kojima et al. | 430/603 |

FOREIGN PATENT DOCUMENTS

| | | | |
|---|---|---|---|
| 800958 | 12/1968 | Canada | 430/603 |
| 0458278 | 11/1991 | European Pat. Off. . | |
| 61-67845 | 4/1986 | Japan . | |
| 61-277942 | 12/1986 | Japan . | |
| 63-65438 | 3/1988 | Japan . | |
| 3236043 | 10/1991 | Japan . | |
| 3260640 | 11/1991 | Japan . | |

OTHER PUBLICATIONS

James, T. H. ed The Theory of the Photographic Process, 4th Edition, 1977, p. 20.

*Primary Examiner*—Janet C. Baxter

*Attorney, Agent, or Firm*—Birch, Stewart, Kolasch & Birch, LLP

[57] ABSTRACT

A silver halide photographic light-sensitive material having at least one silver halide emulsion layer formed on a support, said emulsion layer containing tabular grains having an aspect ratio of 3 or more, which occupy at least 50% of the total projected area of all silver halide grains contained in the emulsion layer. The silver halide grains have been subjected to tellurium sensitization using at least butyl-diisopropylphosphinetelluride as a sensitizer, and also to other chemical sensitization.

14 Claims, 1 Drawing Sheet

SILVER HALIDE PHOTOGRAPHIC LIGHT-SENSITIVE MATERIAL

This application is a continuation of application Ser. No. 07/917,338 filed on Jul. 23, 1992, now abandoned.

BACKGROUND OF THE INVENTION

1. Field of the Invention

The present invention relates to a silver halide photographic light-sensitive material.

2. Description of the Related Art

In the photograph industry, various studies have hitherto been made in order to increase the sensitivity and image quality of silver halide photographic light-sensitive materials. However, the industry has yet to provide materials which have photographic properties good enough to meet the recent demand for materials that can be used in various photographing conditions. To increase the sensitivity and image quality of a silver halide photographic light-sensitive material, it is necessary to enhance the sensitivity of the silver halide gains contained in the light-sensitive material. Various attempts have been made to this end.

One of these attempts is the study of chemical sensitization. Typical examples of chemical sensitization are: sulfur sensitization, selenium sensitization, precious-metal sensitization such as gold sensitization, reduction sensitization, and a combination of these sensitizations.

Tellurium sensitization is known as a chemical sensitization described above, and is generally described in, for example, U.S. Pat. Nos. 1,623,499, 3,320,069, 3,772,031, 3,531,289, and 3,655,394, British Patents 235,211, 1,121, 496, 1,295,462, and 1,396,696, and Canadian Patent 800, 958. However, specific tellurium sensitizers are described in detail in a few publications only, such as British Patents 1,295,462 and 1,396,696, and Canadian Patent 800,958.

Methods of forming and using silver halide tabular grains (hereinafter referred to as "tabular grains"), which are one type of the silver halide grains described above, are described in, for example, U.S. Pat. Nos. 4,434,226, 4,439, 520, 4,414,310, 4,433,048, 4,414,306, and 4,459,353. These methods are known to achieve various advantages, such as increased sensitivity, including the color-sensitization efficiency increased by a sensitizing dye, an improved sensitivity/graininess ratio, increased sharpness owing to the optical properties specific to tabular grains, and increased covering power. As the recent sensitivity of tabular grains is not satisfactory, further improvement has been demanded.

The increasing of the sensitivity of tabular grains has often degraded their pressure property in some cases because of their shape. Thus, the technique of increasing the sensitivity of tabular grains, without degrading the pressure property thereof, has long been demanded.

SUMMARY OF THE INVENTION

The object of the present invention is to provide a silver halide photographic light-sensitive material containing a tabular silver halide grains which have been tellurium-sensitized, excel in sensitivity/ graininess ratio, and have an improved pressure property.

This object of the invention can be attained by the following means 1 to 3:

1. A silver halide photographic light-sensitive material having at least one silver halide emulsion layer formed on a support, the emulsion layer containing tabular grains having an aspect ratio of 3 or more, which occupy at least 50% of the total projected area of all silver halide grains contained in the emulsion layer, and the silver halide grains having been subjected to chemical sensitization including tellurium sensitization.

2. The silver halide photographic light-sensitive material of the type described in paragraph 1, in which the tabular silver halide grains have at least one dislocation line each.

3. The silver halide photographic light-sensitive material of the type described in paragraph 1, in which the tabular silver halide grains have been subjected to chemical sensitization including tellurium sensitization using, as a tellurium sensitizer, at least one tellurium compound represented by the following formula (I) or (II):

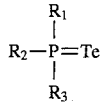

Formula (I)

where $R_1$, $R_2$ and $R_3$ represent aliphatic groups, aromatic groups, heterocyclic groups, $OR_4$, $NR_5(R_6)$, $SR_7$, $OSiR_8(R_9)(R_{10})$, $TeR_{11}$, X or hydrogen atoms, $R_4$, $R_7$, and $R_{11}$ represent aliphatic groups, aromatic groups, heterocyclic group, hydrogen atoms or cations, $R_5$ and $R_6$ represent aliphatic groups, aromatic groups, heterocyclic groups or hydrogen atoms, $R_8$, $R_9$ and $R_{10}$ represent aliphatic groups, and X represents a halogen atom;

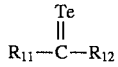

Formula (II)

where $R_{11}$ represents aliphatic group, aromatic group, heterocyclic group or $—NR_{13}$ $(R_{14})$, $R_{12}$ represents $—NR_{15}(R_{16})$, $—N(R_{17})N(R_{18})R_{19}$ or $—OR_{20}$, $R_{13}$, $R_{14}$, $R_{15}$, $R_{16}$, $R_{17}$, $R_{18}$, $R_{19}$, and $R_{20}$ represent hydrogen atoms, aliphatic groups, aromatic groups, heterocyclic groups or acyl groups, $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ can combine, forming a ring.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1:
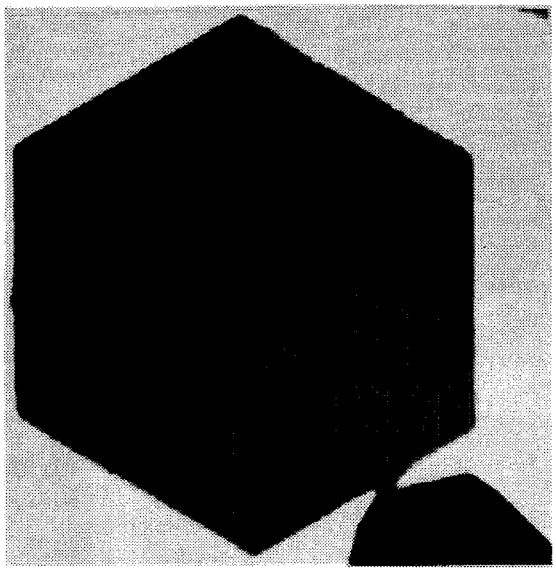
FIG. 1 is an electron-microscope photograph of the typical silver halide grains contained in the emulsion Em-H1 prepared in Example 3.

The present invention will now be described in detail below.

In the emulsion used in the silver halide photographic light-sensitive material of the invention, tabular silver halide grains having an aspect ratio of 3 or more, but preferably less than 8, occupy at least 50% of the total projected area of all silver halide grains contained in the emulsion. The term "tabular silver halide grains (tabular grains)" is a general name for silver halide grains having one twin face or two or more parallel twin planes. A "twin plane" is a (111) face on both sides of which all ions at lattice points have a mirror-image relationship. When this tabular grain is viewed from the above, its shape is a triangle, a hexagon, or a rounded triangle or hexagon like circular. The triangular grains have parallel triangular outer surfaces, the hexagonal grains have parallel hexagonal outer surfaces, and the circular grains have parallel circular outer surfaces.

In the present invention, the term "an average aspect ratio" of tabular grains is an average of the values (i.e., aspect ratios) of the tabular grains which have a thickness of less than 0.5 μm and a diameter of 0.3 μm or more, the value for each grain having been obtained by dividing the diameter of the grain by the thickness thereof. The thickness of each grain can be easily determined in the following method. First, metal is vapor-deposited slantwise with respect to the grain, along with reference latex. Then, the grain and the latex are photographed under an electron photomicrography. Next, the length of the shadow of the grain observed in the photograph is measured. The thickness of the grain is calculated from the length of the shadow, with the length of the latex shadow as reference.

In the present invention, the diameter of each grain is the diameter of a circle which has the same area as the projected area of each parallel outer surface of the grain. The projected are of the grain can be determined by measuring the projected area on an electron photomicrography of the grain, and then by correcting this projected area with the magnification at which the grain has been photographed.

Preferably, the tabular grains of the invention have a diameter, thus defined, of 0.3 to 5.0 μm, and a thickness of 0.05 to 0.5 μm.

In the present invention, tabular grains occupy preferably 50% or more, more preferably 80% or more, of the total projected area of all silver halide grains contained in the emulsion, and, more preferably, the tabular grains which occupy said specific part of the total projected area have an average aspect ratio of 3 or more, but less than 8.

The tabular grains for use in the present invention can be prepared by an appropriate combination of the methods known in the art.

For example, seed crystals, 40% or more by weight of which are tabular grains, are formed in a comparatively high pAg atmosphere having a pBr of 1.3, and then are grown while adding a silver salt solution and a halogen solution and while maintaining a similar or greater pBr value.

It is desirable that said silver salt solution and said halogen solution be added such that no new crystal nuclei are formed during the growth of grains being achieved by the addition of one or both of a water soluble silver salt, such as, silver nitrate, and a water soluble halogen.

The size of tabular silver halide grains can be adjusted, for example, by adjusting the temperature, selecting the type or amount of solvent, and controlling the speed of adding silver salt and halide used in grain growth.

As for these adjustings, the descriptions in, for example, U.S. Pat. Nos. 1,335,925, 3,672,900, 3,650,757, 4,242,445, JP-A-55-1423229, and JP-A-55-158124 ("JP-A" means Published Unexamined Japanese Patent Application.) can be referred to.

In order to accelerate the ripening of silver halide grains, a silver halide solvent is useful. As is known in the art, an excessive amount of halogen ions, for example, may be introduced in the reaction vessel to accelerate the ripening. Therefore, it is clear that the ripening can be accelerated, merely by introducing an aqueous solution of a halide into the reaction vessel. Other ripening agents can be used along with halogen ions. These ripening agents can be added, in their entirety, to the dispersion medium contained in the reaction vessel before silver salt and halide salt are introduced into the vessel, or can be introduced into the reaction vessel together with one or more halide salts, silver salt, or deflocculant. Alternatively, the ripening agents can be independently introduced at the stage of adding the halide salt and the silver salt.

As ripening agents other than halogen ions, there can be used ammonia, an amine compound, and a thiocyanate such as an alkali metal thiocyanate, especially sodium thiocyanate or potassium thiocyanate and ammonium thiocyanate. Use of thiocyanate as a ripening agent is disclosed in U.S. Pat. Nos. 2,222,264, 2,448,534, and 3,320,069. Also, the known thioether ripening agents can be used, the examples of which are disclosed in U.S. Pat. Nos. 3,271,157, 3,574,628, and 3,737,313. Alternatively, thione compound of the type disclosed in JP-A-53-82408 and JP-A-53-144319 can be used.

Further, various compounds can be used during the step of forming silver halide precipitate, to thereby control the properties of the silver halide grains. These compounds may be introduced into the vessel from the beginning, or may be added together with one or more salts by the ordinary method. More specifically, compounds of copper, iridium, lead, bismuth, cadmium, zinc, (chalcogens of sulfur, selenium and tellurium), and compounds of gold and precious metals of Group VIII can be used during the step of forming silver halide precipitate, thereby controlling the properties of the silver halide grains, as is described in U.S. Pat. Nos. 2,448,060, 2,628,167, 3,737,313 and 3,772,031, and Research Disclosure (hereinafter referred to as "R.D."), Vol. 134, 13452, June 1975.

It is desirable that the silver halide emulsion of the present invention is subjected to reduction sensitization during the forming of grains, after the forming of grains and before, during or after the chemical sensitization other than the reduction sensitization.

The reduction sensitization can be the method of adding a reduction sensitizer to the silver halide emulsion, the silver ripening method in which silver halide grains are grown or ripened in a low-pAg atmosphere having a pAg value of 1 to 7, or the high-pH ripening method in which silver halide grains are grown or ripened in a high-pH atmosphere having a pH value of 8 to 11. Alternatively, two of these methods can be used in combination.

The method of adding said reduction sensitizer to the silver halide emulsion is preferable in that it can minutely control the level of reduction sensitization.

Known as reduction sensitizers are, for example, stannate, ascorbic acid, a derivative thereof, amine, polyamine, hydrazine derivative, formamidinesulfinic acid, silane compound, and borane compound. Any reduction sensitizer selected from these known ones can be used in the present invention. Two or more compounds can be used in combination in the present invention. Preferable as reduction sensitizers for use in the present invention are stannous chloride, thiourea dioxide, dimethylamineborane, ascorbic acid, and derivative thereof. The amount in which to added the reduction sensitization in the present invention should be determined from the conditions in which the emulsion is manufactured. The appropriate range of the amount is $10^{-7}$ to $10^{-3}$ mol per mol of silver halide.

The reduction sensitizer is dissolved in, for example, water, alcohol, gylcol, ketone, ester, or amide, thus forming a solution. This solution is added during the forming of grains. Although the solution can be introduced into the reaction vessel beforehand, the method of adding the solution at a proper time during the growth of silver halide grains is preferred. Alternatively, the reduction sensitizer may be added to an aqueous solution of water-soluble silver salt or water-soluble alkali halide, and the resultant solution may be applied, thereby precipitating silver halide grains. Another preferable method is to add the reduction sensitizer solution several times, in portions, or continuously over a long time, as while the silver halide grains are growing.

The treatment disclosed in, for example, European Patents 96,727B1 and 64,412B1 may be performed on the silver halide emulsion for use in the present invention, in order to round the grains contained in the emulsion. Alternatively, the treatment disclosed in, for example, West German Patent 2,306,447C2 and JP-A-221320 may be conducted on the emulsion, in order to modify the surfaces of the grains.

The grains in the silver halide emulsion of the present invention generally have flat surfaces, but it is desirable that concavo-convex curvature be formed in the surface of each grain. Examples of such grains are those disclosed in JP-A-58-106532 and JP-A-60-221320, each of which has holes made in the apices or in the center portion of the surfaces, and ruffled grains which are disclosed in U.S. Pat. No. 4,643,966.

It is desirable that the tabular grains in the emulsion for use in the present invention have at least one dislocation line each. The dislocation line may be one extending straight in a specific crystal orientation, one curving, one introduced throughout the grain, one introduced in only a specified portion of the grain, e.g., the fringe thereof.

As is well known, dislocation is displacement of a series of atoms which is observed at crystal lattices. Its general definition is described in, for example, Shuji Suzuki, "Introduction to Theory of Dislocation," Agne Press, 1968, pp. 24–31.

Hirsch et al., (Electron Microscopy of Thin Crystals," Butterworths, London, 1965, pp. 166–188) teaches that dislocation lines in crystals can be observed by means of an electron microscope, and describes how contrast changes with the tilt angle of the sample.

Dislocation in silver halide grains can be observed by the methods described in, for example, Hamilton, Photgr. Sci. Eng., 11, 57 (1967) and Shiozawa, J. Soc. Phot. Sci. Jap., 34, 16 (1971) and 35, 213 (1972).

Manufacture and observation of the samples of silver halide grains, to examine by means of an electron microscope, are applied by the method described in Shiozawa, J. Soc. Phot. Sci. Jap., 34, 16 (1971).

When silver halide grains are examined by an electron microscope, not only dislocation lines but also interference fringe of equal inclination, stacking fault, print-out silver and moires visualized by electron-beam irradiation when examined by an electron microscope. These images observed are all generally known.

The causes of the contrast of these images and the method of identifying these images are reported by Hirsch et al (said above). and the silver halide grains are described by Hamilton (said above). These image can be distinguished from the images of dislocation lines.

The method of measuring dislocation-line density, and the method of determining the density distribution among grains will be described.

The density of dislocation lines is the number of the dislocation lines existing in one grain. It is measured by the following method. First, a grain is rotated with respect to the incident electron beams and is photographed every time it is tilted at a specific angle to the beams, thus obtaining photographs. The dislocation lines in each photograph are counted, thereby determining how many dislocation lines the grain has. If the dislocation lines observed on any photograph are too dense to count them, the grain is considered to have a great number of dislocation lines. The distribution of the dislocation-line density, among the gains, is determined by examining 200 or more grains, preferably 300 or more grains, for their dislocation-line densities, and by recording the number of each group of grains which have dislocation-line densities falling within a specific range.

The size of silver halide grains contained in the emulsion for use in the present invention can be evaluated, for example, in terms of the equivalent-circle diameter of the grain calculated from the projected area measured by means of an electron microscope, the equivalent-sphere diameter of the grain calculated from the volume obtained from the projected area and thickness of the grain, or the equivalent-sphere diameter of the grain calculated from the volume determined by coaltar counter method. Grains for use in the present invention can be selected from those of various sizes—from very tiny grains having an equivalent-sphere diameter of 0.05 microns or less to large grains having an equivalent-sphere diameter of 10 microns or more. Preferably, grains having a diameter of 0.1 to 3 microns are used as light-sensitive silver halide grains.

Either a polydispersed emulsion, i.e., an emulsion containing silver halide grains of various sizes, or a monodispersed emulsion, i.e., an emulsion containing silver halide grains of limited sizes, can be used in accordance with the use. The size distribution of silver halide grains is represented by the variation coefficient in terms of the equivalent-circuit diameter calculated from the projected area of each grain, or in terms of the equivalent-sphere diameter calculated from the volume of each grain. In the case of a monodispersed emulsion, it is desirable that use be made of grains which have a variation coefficient of 25% or less, preferably 20% or less, more preferably 15% or less.

In some cases, a monodispersed emulsion is defined as one in which grains having a diameter deviating ±30% or less from the average diameter occupy 80% or more of all grains in terms of number or weight. To impart a desired gradation to the light-sensitive material, two or more monodispersed emulsions having different grain size can be coated in the form of a mixture to form an emulsion layer sensitive to a specific color, or can be coated independently to form two or more emulsion layers sensitive to substantially the same color. Alternatively, two or more polydispersed emulsions or two or more monodispersed and polydispersed emulsions can be coated in the form of a mixture to form an emulsion layer or independently to form a plurality of emulsion layers.

The silver halide grains according to the present invention are made of silver bromide, silver chloride, silver iodide, silver chlorobromide, silver chloroiodide, silver bromoiodide, or silver bromochloroiodide. The emulsion of the present invention may contain not only these silver halide grains, but also grains made of any silver salt, such as silver rhodanide, silver sulfide, silver selenide, silver carbonate, silver phosphate or silver salt of organic acid. Alternatively, the emulsion may contain silver halide grains each containing any silver salt exemplified. To prepare a silver halide photographic light-sensitive material which can be developed and desilvered (i.e., bleached, fixed and bleach-fixed) at high speeds, it is desirable that the silver halide grains have a high silver chloride content. To prepare a silver halide photographic light-sensitive material which can be developed slowly, it is preferable that the silver halide grains contain silver iodide. The optimum amount in which to use silver iodide depends on the type of the light-sensitive material. Preferably, the silver iodide content is 0.1 to 15 mol % for X-ray sensitive material, and 0.1 to 5 mol % for microfilm and graphic art film. For photographic light-sensitive materials the typical example of which is color negative film, the silver iodide content ranges from 1 to 30 mol %, preferably 5 to 20 mol %, more preferably 8 to 15 mol %. In order to lessen lattice strain in each silver halide grain, it is recommendable that silver chloride be contained in the grain.

It is desirable that the silver halide emulsion has, in its grains, a distribution or a structure with respect to a halogen composition. Typical examples of such grains are those of double structure, each consisting of a core and shell which have different halogen compositions, as is disclosed in, for example, JP-B-43-13162, JP-A-61-215540, JP-A-60-222845, JP-A-60-143331, and JP-A-61-75337. ("JP-B" means Published Examined Japanese Patent Application.) Other examples of such grains are: those of triple structure, each formed of a core, a first shell and a second shell which have different halogen compositions, as is disclosed in JP-A-60-222844; and those consisting four or more layers. Still another example is grains of double structure, each coated with a thin layer of silver halide which has a halogen composition different from those of the core and shell.

Apart from the grains of the three types described in the preceding paragraph, grains having so-called junction structure can be used in the present invention. Various examples of grains having the junction structure are disclosed in JP-A-59-133540, JP-A-58-108526, European Patent 199, 290A2, JP-A-58-24772, JP-A-59-16254, and some other references. A junction-structure grain consists of a host crystal and a junction crystal which is different in composition from the host crystal and attached to the edge, corner or face parts of the host crystal. The host crystal is one which is homogeneous in halogen composition or one which has a core-shell structure.

The host crystal and junction crystal forming a junction-structure grain can, of course, be made of different silver halides. Further, one of these crystals can be made of a silver chloride of non-halite structure, such as silver rhodanide and silver carbonate, provided that it can be attached to the crystal which is made of silver halide. If possible, one of these crystals can be made of a silver chloride of non-halide structure, such as lead oxide.

In the case of silver iodide grains having the core-shell structure, it is desirable that the core contain more silver iodide than the shell. In some cases, the core should better contain less silver iodide than the shell. As for silver iodide grains having the junction structure, it is desirable that the host crystal contains more silver iodide than the junction crystal in some cases, and less silver iodide than the junction crystal in other cases. In either a core-shell grain or a junction-structure grain, the two components can have a distinct boundary and an indistinct boundary. Alternatively, the boundary between the two components can have a composition which gradually changes from one component to the other.

When the silver halide grains used are those formed of two or more silver halides which are present in the form of a mixed crystal or a core-shell structure, it is important to control the halogen distribution among the grains. A method of measuring the halogen distribution is disclosed in JP-A-60254032. The more uniform the halogen distribution among the grains, the better. A silver halide emulsion containing grains whose variation coefficient is 20% or less is particularly desirable. Another preferable emulsion is one in which the grain size is correlated to the halogen composition of the grain, more specifically the iodine content of each grain is proportional to its size. A silver halide emulsion can be used in which the iodide content of each grain is inversely proportional to the grain size, or in which the grain size and the content of any other halogen are correlated, in accordance with the use of the light-sensitive material. In view of this it would be recommendable that two or more emulsions having different composition be mixed and used.

It is also essential to control the halogen composition in the near-surface region of the silver halide grains of the present invention. More specifically, the content of silver iodide or silver chloride in the near-surface region should be increased to change the dye-adsorbing efficiency or developing speed of the grain, in accordance of the use of the light-sensitive material. In order to change the halogen composition in the near-surface region, a layer can be formed, either covering the entire grain or covering only part of the grain. In the case of a tabular grain, for example, the halogen composition is changed in either one major surface or one side.

Gelatin is suitable for use in the emulsion of the present invention, as protective colloid and as binder in a layer made of any other hydrophilic colloid layer. Also, any other hydrophilic colloid can be used.

Examples of other hydrophilic colloid are: proteins such as a graft polymer of gelatin and a high-molecular weight substance, albumin, and casein; cellulose derivatives such as hydroxyethyl cellulose, carboxymethyl cellulose, and cellulose sulfate ester; sugar derivatives such as sodium arginate and starch derivative; and synthetic hydrophilic high-molecular substances such as monopolymer and copolymer (e.g., polyvinyl alcohol, polyvinyl partial acetal, poly-N-vinylpyrrolidone, polyacrylic acid, polymethacrylic acid, polyacrylamide, polyvinylimidazole and polyvinylpyrazole).

Gelatin can not only be lime-treated gelatin, but also acid-treated gelatin or such an enzyme-treated gelatin as is disclosed in Bull. Soc. Sci. Photo. Japan, No. 16, p. 30 (1966). Also, a substance obtained by hydrolyzing gelatin or by decomposing gelatin with an enzyme can be used.

In the present invention, it is particularly desirable that low-molecular gelatin having a molecular weight of 70,000 or more be used during the forming of nuclei.

It is desirable that the emulsion of the present invention be washed with water to be desalted and then be dispersed in a protective colloid newly prepared. The emulsion can be water-washed at any temperature selected in accordance with its use, but preferably at 5° C. to 50° C. It can be water-washed at any pH value selected for its application, but preferably at a pH value ranging from 2 to 10, more preferably at a pH value ranging from 3 to 8. Also, any value can be selected for the pAg at the time of the water-washing, in accordance with the use of the emulsion, but a preferable pAg value is 5 to 10. Further, the emulsion can be washed with water by any known method, such as noodle water-washing, dialysis, centrifugal separation, precipitation, or ion exchange. In the case of precipitation, use can be made of a sulfate, an organic solvent, a water-soluble polymer, or a gelatin derivative.

The silver halide grains contained in the silver halide emulsion of the present invention are necessarily subjected to chemical sensitization including tellurium sensitization.

Tellurium sensitization will be explained.

Tellurium sensitizers for use in the present invention are, for example, the compounds which are described in U.S. Pat. Nos. 1,623,499, 3,320,069 and 3,772,031, British Patents 235,211, 1,121,496, 1,295,462 and 1,396,696, Canadian Patent 800,958, Journal of Chemical Society Chemical Communication 635 (1980), ibid. 1102 (1979), ibid. 645 (1979), and Journal of Chemical Society Perkin Transaction 1, 2191 (1908). Specific examples of the tellurium sensitizers are: colloidal tellurium, telluroureas (e.g., allyltellurourea, N,N-dimethyl tellurourea, tetramethyl tellurourea, N-carboxyethyl-N',N'-dimethyltellurourea, and N,N'-diphenylethylene tellurourea), isotellurocyanates (e.g., allylisotellurocyanate), telluroketones (e.g., telluroacetone and telluroacetophenone), telluroamides (e.g., telluroacetoamide and N,N-dimethyl tellurobenzamide), tellurohydrazides (e.g., N,N',N'-trimethyl tellurobenzhydrazide), telluroester (e.g., t-butyl-t-hexyl telluroester), phosphinetellurides (e.g., tributyl phosphinetelluride, tricyclohexyl phosphinetelluride, triisopropyl phosphinetelluride, butyl-diisopropyl phosphinetelluride, and dibutylphenyl phosphinetelluride), and other tellurium compounds (e.g., potassium telluride, potassium tellurocyanate, telluropentathionate sodium salt, allyltellurocyanate, and gelatin containing negatively charged telluride ions, as disclosed in British Patent 1,295,462).

Of the tellurium compounds specified above, those represented by the formula (I) or (II) represented above are preferred.

In the formula (I), $R_1$, $R_2$ and $R_3$ represent aliphatic groups, aromatic groups, heterocyclic groups, $OR_4$, $NR_5(R_6)$, $SR_7$, $OSiR_8(R_9)(R_{10})$, $TeR_{11}$, X or hydrogen atoms, $R_4$, $R_7$, and $R_{11}$ represent aliphatic groups, aromatic groups, heterocyclic group, hydrogen atoms or cations, $R_5$ and $R_6$ represent aliphatic groups, aromatic groups, heterocyclic groups or hydrogen atoms, $R_8$, $R_9$ and $R_{10}$ are aliphatic groups, and X is a halogen atom.

In the formula (I), if $R_1$, $R_2$, $R_3$, $R_4$, $R_5$, $R_6$, $R_7$, $R_8$, $R_9$, $R_{10}$, and $R_{11}$ represent aliphatic groups, they are preferably those having 1 to 30 carbon atoms. Particularly preferable are an alkyl group, alkenyl group, alkynyl group, and aralkyl group, each having 1 to 20 carbon atoms and present in the form of a straight chain, a branch, or a ring. Examples of an alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

In the formula (I), if $R_1$, $R_2$, $R_3$, $R_4$, $R_5$, $R_6$, $R_7$, and $R_{11}$ are aromatic groups, there are preferably those having 6 to 30 carbon atoms. Particularly preferred is an aryl group having 6 to 20 carbon atoms and present in the form of a single ring or a condensed ring, such as a phenyl group or naphthyl group.

In the formula (I), if $R_1$, $R_2$, $R_3$, $R_4$, $R_5$, $R_6$, $R_7$, and $R_{11}$ represent heterocyclic groups, they are saturated or unsaturated 3- to 10-membered heterocyclic groups, each having at least one atom selected from the group consisting of a nitrogen atom, an oxygen atom and a sulfur atom. They can form a single ring, or can combine with an aromatic group or another heterocyclic group, thus forming a condensed ring. Preferable are 5- or 6-membered aromatic heterocyclic groups such as pyridyl, furyl, thienyl, thiazolyl, imidazolyl, and benzimidazolyl.

In the formula (I), if $R_4$, $R_7$, and $R_{11}$ represent cations, they are of alkali metal or ammonium.

In the formula (I), if X represents a halogen atom, it is, for example, a fluorine atom, a chlorine atom, a bromine atom, or a iodine atom.

The aliphatic groups, the aromatic groups, and the heterocyclic groups—all specified above—can be substituted.

Typical examples of the substituent groups are: alkyl group, aralkyl group, alkenyl group, alkynyl group, aryl group, alkoxy group, aryloxy group, amino group, acylamino group, ureido group, urethane group, sulfonylamino group, sulfamoyl group, carbamoyl group, sulfonyl group, sulfinyl group, alkyloxycarbonyl group, aryloxycarbonyl group, acyl group, acyloxy group, phosphoric acid group, diacylamino group, imido group, alkylthio group, arylthio group, a halogen atom, cyano group, sulfo group, carboxyl group, hydroxyl group, phosphono group, nitro group, and heterocyclic group. These groups can be substituted.

In the case where two or more substituent groups are used, they can be either identical or different.

$R_1$, $R_2$, and $R_3$ can combine together and with phosphorus atoms, forming a ring. Alternatively, $R_5$ and $R_6$ can combine, forming a nitrogen-containing heterocyclic ring.

In the formula (I), $R_1$, $R_2$, and $R_3$ are preferably aliphatic groups or aromatic groups. More preferably, they are alkyl groups or aromatic groups.

The formula (II) will be explained in detail.

In the formula (II), $R_{11}$ represents an aliphatic group, aromatic group, heterocyclic group or $—NR_{13}(R_{14})$, $R_{12}$ represents $—NR_{15}(R_{16})$, $—N(R_{17})N(R_{18})R_{19}$ or $—OR_{20}$, $R_{13}$, $R_{14}$, $R_{15}$, $R_{16}$, $R_{17}$, $R_{19}$ and $R_{20}$ represent hydrogen atoms, aliphatic groups, aromatic groups, heterocyclic groups or acyl groups, $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ can combine, forming a ring.

In the formula (II), if $R_{11}$, $R_{13}$, $R_{14}$, $R_{15}$, $R_{16}$, $R_{17}$, $R_{18}$, $R_{19}$, and $R_{20}$ represent aliphatic groups, they are preferably those having 1 to 30 carbon atoms. Particularly preferable are an alkyl group, alkenyl group, alkynyl group, and aralkyl group, each having 1 to 20 carbon atoms and present in the form of a straight chain, a branch, or a ring. Examples of an alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

In the formula (II), if $R_{11}$, $R_{13}$, $R_{14}$, $R_{15}$, $R_{16}$, $R_{17}$, $R_{18}$, $R_{19}$, and $R_{20}$ represent aromatic groups, they are preferably those having 6 to 30 carbon atoms. Particularly preferred is an aryl group having 6 to 20 carbon atoms and present in the form of a single ring or a condensed ring, such as phenyl group or naphthyl group.

In the formula (II), if $R_{11}$, $R_{13}$, $R_{14}$, $R_{15}$, $R_{16}$, $R_{17}$, $R_{18}$, $R_{19}$, and $R_{20}$ represent heterocyclic groups $R_{20}$, they are saturated or unsaturated 3- to 10-membered heterocyclic groups, each having at least one atom selected from the group consisting of a nitrogen atom, an oxygen atom and a sulfur atom. They can be each a single ring, or can combine with an aromatic group or another heterocyclic group, thus forming a condensed ring. Preferable are 5- or 6-membered aromatic heterocyclic group such as pyridyl, furyl, thienyl, thiazolyl, imidazolyl, and benzimidazolyl.

In the formula (II), if $R_{13}$, $R_{14}$, $R_{15}$, $R_{16}$, $R_{17}$, $R_{18}$, $R_{19}$, and $R_{20}$ represent acyl groups, they have 1 to 30 carbon atoms. More preferably, they are acyl groups having 1 to 20 carbon atoms and present in the form of a straight chain or a branch. Examples of these acyl groups are acetyl, benzoyl, formyl, pivaloyl, and decanoyl.

In the case where $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ combine, forming a ring, the ring is, for example, an alkylene group, arylene group, aralkylene group, or alkenylene group.

In the formula (II), the aliphatic groups, the aromatic groups, and the heterocyclic groups, described above, can be substituted by the substituent groups specified in the general formula (I).

In the formula (II), $R_{11}$ represents preferably an aliphatic group, aromatic group, or $—NR_{13}(R_{14})$, and $R_{12}$ is $—NR_{15}(R_{16})$. $R_{13}$, $R_{14}$, $R_{15}$ and $R_{16}$ represent aliphatic groups or aromatic groups.

More preferably, in the formula (II), $R_{11}$ represents an aromatic group or $—NR_{13}(R_{14})$, $R_{12}$ represents $—NR_{15}(R_{16})$. In this case, $R_{13}$, $R_{14}$, $R_{15}$ and $R_{16}$ are alkyl groups or aromatic groups. Preferably, $R_{11}$ and $R_{15}$, and $R_{13}$ and $R_{15}$ are attached to each other through an alkylene group, allylene group, aralkylene group, or alkenylene group.

Specific examples 1 to 38 of the compounds represented by the formulas (I) and (II) will be specified in Table A (later presented). Nonetheless, the compounds used in the present invention are not limited to these specified below.

The compounds of the formulas (I) and (II), which are used in the present invention, can be synthesized by the methods known in the art, as is disclosed in Journal of Chemical Society (A), 2927 (1969); Journal of Organometallic Chemistry, 4,320 (1965); ibid, 1,200 (1963); ibid, 113, C35 (1976); Phosphorus Sulfur 15, 155 (1983); Chemische Berichte, 109, 2996 (1976); Journal of Chemical Society Chemical Communication, 635 (1980); ibid; 1102 (1979); ibid, 645 (1979); ibid, 820 (1987); Journal of Chemical Society Perkin Transaction 1,2191 (1980); The Chemistry of Organo Selenium and Tellurium Compounds, Vol. 2, pp. 216–267 (1987).

No specific examples in which use is made of the compounds of the formulas (I) and (II) have been reported. It is therefore difficult to predict whether or not these compounds perform sensitization and fogging and other photographic functions. However, it has become obvious that the compound specified above can achieve remarkable advantages if used in the light-sensitive material according to the present invention.

The tellurium sensitizers used in the tellurium sensitization of the present invention are compounds which form silver telluride in the surface or interior of a silver halide grain, which is considered to function as a sensitization nucleus.

The speed with which silver telluride is formed in the silver halide emulsion can be determined by the following test.

When a tellurium sensitizer is added in a great amount (e.g., $1\times10^{-3}$ mol/mol Ag), the silver telluride formed absorbs the visible region of a light beam. Hence, the method disclosed in E. Moisar, "Journal of Photographic Science," vol. 14, p. 181 (1966) and ibid., vol. 16, p. 102 (1968) can be applied for sulfur sensitizers. Therefore, the relative speed at which silver telluride is formed can easily be obtained by the same method as used in determining the amount of silver sulfide formed in a silver halide emulsion from the infinite reflectivity of the emulsion to visible light beams (520 nm) in accordance the Kubelka-Munk formula. Since this reaction is apparently similar to a first-order reaction, a pseudo-first-order reaction rate constant can be obtained, too.

It will now be described how to obtain a pseudo-first-order reaction rate constant.

An emulsion which contains octahedral silver bromide grains having an average size of 0.5 μm (containing 0.75 mol of AgBr and 80 g of gelatin per kilogram) is maintained at 50° C., while holding pH and pAg at 6.3 and 8.3, respectively. A telluride dissolved in an organic solvent (e.g., methanol) is added to the emulsion, in an amount of $1\times10^{-3}$ mol/mol Ag. The resultant emulsion is filled in a cell having a thickness of 1 cm. Then, the reflectivity (R) of the emulsion to light beams of 520 nm is detected at times by means of a spectrophotometer having an integrating sphere, using the reflectivity of a blank emulsion as reference. Every reflectivity, thus detected, is substituted in the Kubelka-Munk formula, $(1-R)^2/2R$. The time spent until the value of $(1-R)^2/2R$ becomes 0.01 is measured. The pseudo-first-order reaction rate constant k ($min^{-1}$) is determined from the time thus measured. If no silver telluride is formed at all, R=1, and the Kubelka-Munk value is 0 as in the case where no telluride is present. Preferable is a compound which is found to have a pseudo-first-order reaction rate constant k of $1\times10^{-8}$ to $1\times10^{0}$ $min^{-1}$ when tested in exactly the same way as described above.

The pseudo-first-order reaction rate constants of the tellurium sensitizers used in the present invention, which have been obtained by performing the test described above, are as follows:

| | |
|---|---|
| Compound 7 | $k \approx 4\times10^{-3}$ $min^{-1}$ |
| Compound 10 | $k \approx 2\times10^{-3}$ $min^{-1}$ |
| Compound 12 | $k \approx 8\times10^{-4}$ $min^{-1}$ |
| Compound 18 | $k \approx 2\times10^{-4}$ $min^{-1}$ |
| Compound 4 | $k \approx 7\times10^{-5}$ $min^{-1}$ |

In the case where a tellurium sensitizer is added in so small an amount that the absorption of a light beam of the visible region can hardly be detected, the silver telluride formed can be isolated from the unreacted tellurium sensitizer, to determine the quantity of the silver telluride. For instance, the emulsion is immersed in an aqueous solution of a halogen salt or a water-soluble mercapto compound, thereby isolating the silver telluride from the unreacted tellurium sensitizer, and then a small amount of tellurium is quantitatively analyzed by means of atomic absorption spectrometry. The reaction rate greatly varies by several orders, in accordance with not only the type of the compound but also the silver halide composition of the emulsion tested, the test temperature, the values of pAg and pH, and the like.

The tellurium sensitizers preferred for use in the present invention are compounds which can form silver telluride when reacted with a silver halide emulsion which has halogen compositions and crystal habit. Generally speaking, any compound is used in the present invention, that reacts with a silver halide emulsion at a temperature of 40° to 95° C., at a pH of 3 to 10, or at a pAg of 6 to 11. More preferable as a tellurium sensitizer is a compound which has a pseudo-first-order reaction rate constant k of $1\times10^{-7}$ to $1\times10^{-1}$ $min^{-1}$ if tested by the method specified above at a temperature of 40° to 95° C., at a pH of 3 to 10, or at a pAg of 6 to 11.

In the present invention, tellurium sensitizers are used in an amount of $10^{-8}$ to $10^{-2}$ mol per mol of silver halide, preferably $10^{-7}$ to $5\times10^{-3}$ mol per mol of silver halide, depending on the type of silver halide grains used and the conditions of chemical sensitization performed.

There is no limitation to the conditions in which to effect chemical sensitization in the present invention. However, it is desirable that the silver halide grains be chemically sensitized at a pAg of 6 to 11, preferably 7 to 10 and at a temperature of 40° to 95° C., preferably 50° to 85° C.

In the method of preparing the silver halide emulsion of the present invention, chemical sensitization is performed on a silver halide emulsion containing tabular grains which have an aspect ratio of 3 or more and which occupy 50% or more of the total projected area of all silver halide grains contained in the emulsion.

More specifically, the silver halide emulsion is tellurium-sensitized in the presence of a compound which generates silver telluride at a temperature of 40° to 95° C., at a pH of 3 to 10, or at a pAg of 6 to 11.

Precious-metal sensitizers using gold, platinum, palladium, iridium or the like, should preferably be used in the present invention, along with the tellurium sensitizers. Specific example of precious-metal sensitizers are: chloroauric acid, potassium chloroaurate, potassium auric thiocyanate, gold sulfide, gold selenide, and the like. These precious-metal sensitizers can be used in an amount of about $10^{-7}$ to about $10^{-2}$ mol per mol of silver halide.

In the present invention, it is also preferable to use sulfur sensitizers, too. Specific examples of sulfur sensitizers are: thiosulfates (e.g., hypo), thioureas (e.g., diphenyl thiourea, triethyl thiourea, and allyl thiourea), and known unstable iodides (e.g., rhodanines). These sulfur sensitizers can be used in an amount of about $10^{-7}$ to about $10^{-2}$ mol per silver halide.

Also it is desirable that selenium sensitizers be used, too, in the present invention. The unstable selenium sensitizer disclosed in JP-B-44-15748 is an preferable example. Specific examples of selenium sensitizers are: colloidal selenium, selenoureas (e.g., N,N-dimethyl selenourea, selenourea, tetramethyl selenourea), selenoamides (e.g., selenoaceto amid, N',N'-dimethylselenobenzamide), selenoketones (e.g., selenoacetone, - selenobenzophenone), selenides (e.g., triphenyl phosphineselenide, diethylselenide), selenophosphate (e.g., tri-p-triselenophosphate), selenocarboxylic acid, esters, and isoselenocyanates. These selenium sensitizers can be used in an amount of about $10^{-8}$ to about $10^{-3}$ mol per mol of silver halide.

In the chemical sensitization of the present invention, a reduction sensitizer said above can be used, too.

Preferably, tellurium sensitization is carried out in the present invention, in the presence of a solvent for dissolving the silver halide.

Specific examples of this solvent are: thiocyanate (e.g., potassium thiocyanate), thioether compound (e.g., the compounds disclosed in U.S. Pat. Nos. 3,021,215 and 3,271,157, JP-B-58-30571, and JP-A-60-136736, particularly 3,6-dithia-1,8-octadiol), and tetra-substituted thiourea compound (e.g., the compounds disclosed in JP-B-59-11892 and U.S. Pat. No. 4,221,863, particularly tetramethyl thiourea). Other examples of the solvent are: the thione compounds disclosed in JP-B-60-11341, the mercapto compounds disclosed in JP-B-63029727, the mesoion compounds disclosed in JP-A-60-163042, the selenoether compounds disclosed in U.S. Pat. No. 4,782,013, the telluoether compounds disclosed in JP-A-2-118566, and sulfides. Of these examples, thiocyanate, thioether compendious, tetra-substituted thiourea compounds, and thione compounds are preferred. The solvent can be used in an amount of about $10^{-5}$ to about $10^{-2}$ tool per mol of silver halide.

The present invention relates to a silver halide emulsion and a method of preparing the emulsion, too. The characterizing features of the emulsion and the method are common to the silver halide photographic light-sensitive material. They can be understood by those skilled in the art, from the above description of the light-sensitive material. Typical silver halide emulsions according to the present invention, and the methods of preparing these emulsions will be described below. Needless to say, these emulsions and methods can incorporate the technical concepts set forth in claim 2 and claims 4 et seq. of the present application.

The photographic emulsion for use in the invention can contain various compounds to prevent fogging from occurring during the manufacture, storage or processing of the light-sensitive material, and to stabilize the photographic properties of the light-sensitive material. More precisely, compounds known as antifoggants and stabilizing agents can be added to the emulsion. Examples of these compounds are: thiazoles such as benzothiazolium salt; nitroimidazoles; nitrobenzimidazoles; chlorobenzimidazoles; bromobenzimidazoles; mercapto thiazoles; mercapto benzothiazoles; mercapto benzimidazoles; mercapto thiadiazoles; aminotriazoles; benzotriazoles; nitrobenzotriazoles; mercapto tetrazoles, particularly, 1-phenyl-5-mercapto tetrazole; mercapto pyrimidines; mercapto triazines; thioketo compounds such as oxadolinethione; azaindenes such as triazaindene and tetraazaindene (particularly, 4-hydroxy-substituted (1, 3, 3a, 7) tetraazaindenes); pentaazaindenes. The compounds disclosed in, for example, U.S. Pat. Nos. 3,954,474 and 3,982,947 and JP-B-52-28660 can be used as antifoggants and stabilizing agents. One of the compounds which are preferable for use in the invention is disclosed in JP-A-63-212932. These antifoggants and stabilizing agents can be added before, during or after the forming of grains, during water-washing, during the dispersion process subsequent to the water-washing, before, during or after chemical sensitization, or before a coating process, in accordance with the purpose for which the antifoggants and the stabilizing agents are used. The antifoggants and the stabilizing agents can be used, not only to prevent fogging and stabilize the photographic properties of the light-sensitive material, but also to control the crystal habit of the grains, reduce the grain size, decrease the solubility of the grain, control the chemical sensitization, and modify the arrangement of dye particles.

It is desirable that the photographic emulsion used in the present invention be spectrally sensitized with methine dyes or the like, thereby to achieve the advantages expected of the present invention. Examples of the dyes used are: cyanine dye, melocyanine dye, composite cyanine dye, composite melocyanine dye, holopolar cyanine dye, hemicyanine dye, styryl dye, and hemioxonol dye. Of these dyes, particularly useful are cyanine dye, melocyanine dye, and composite melocyanine dye. These dyes contains nuclei which are usually used in cyanine dyes as basic heterocyclic nuclei. Examples of the nuclei are nuclei such as pyrroline, oxazoline, thiazoline, pyrrole, oxazole, thiazole, selenazole, imidazole, teterazole, and pyridine; nuclei each formed of any one of these nuclei and an alicylic hydrocarbon ring fused to the nucleus; and nuclei each formed of any one of these nuclei and an aromatic hydrocarbon ring fused to the nucleus, such as indolenine, benzindolenine, indole, benzoxazole, naphthoxazole, benzothiazole, naphthothiazole, benzoselenazole, benzimidazole, and quinoline. These nuclei can be substituted at carbon atoms.

Melocyanine dye or composite melocyanine dye can be one which has nuclei of ketomethylene structure. Applicable as such nuclei are 5- or 6-membered heterocyclic nuclei of pyrazoline-5-on, thiohydantoin, 2-thiooxazoline-2,4-dione, thiazolidine-2,4-dione, rhodanine or thiobarbituric acid.

These sensitizing dyes can be used, either singly or in combination. In many cases, they are used in combination, for achieving supersensitization, as is disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618, and JP-A-52-109925.

The emulsion can contain not only the sensitizing dye, but also a dye which has no sensitizing ability or a substance which absorbs virtually no visible light and has supersensitizing ability.

The sensitizing dye can be added at any time during the preparation of any emulsion that has been hitherto known as useful. In most cases, the dye is added after the chemical sensitization and before the coating of the emulsion. However, it can be added at the same time the chemical sensitizer is added, thereby to accomplish spectral sensitization and chemical sensitization at the same time, as is disclosed in U.S. Pat. Nos. 3,628,969 and 4,225,666. Alternatively, it can be added before the chemical sensitization, to initiate spectral sensitization, as is described in JP-A-58-113928. Also, it can be added before the precipitation of silver halide grains, to initiate spectral sensitization. Still alternatively, it can be added in two portions before and after chemical sensitization, respectively, as is disclosed in U.S. Pat. No. 4,225,666. Moreover, it can be added at any time during the forming of silver halide grains, as is described in U.S. Pat. No. 4,183,756.

The amount in which to add the sensitizing dye is $4\times10^{-6}$ to $8\times10^{-3}$ mol per mol of silver halide used. The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different sensitivities. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

Also, an order of, for example, high-sensitivity emulsion layer/low-sensitivity emulsion layer/medium-sensitivity emulsion layer, or low-sensitivity emulsion layer/medium-sensitivity emulsion layer/high-sensitivity emulsion layer may be adopted. Furthermore, the arrangement can be changed as described above even when four or more layers are formed.

To improve color reproduction, a donor layer (CL) can be bonded to, or arranged adjacent to, a major light-sensitive layer BL, GL or RL. The donor layer should have a spectral sensitivity distribution which is different from that of the major light-sensitive layer. Donor layers of this type are disclosed in U.S. Pat. Nos. 4,663,271, 4,705,744 and 4,707,436, JP-A-62-160448, and JP-A-63-89850.

As described above, various layer types and arrangements can be selected in accordance with the application of the light-sensitive material.

Silver halide grains for use in the present invention, other than the tabular grains described above, will be described. A preferable silver halide contained in photographic emulsion layers of the photographic light-sensitive material of the present invention is silver bromoiodide, silver chloroiodide, or silver chlorobromoiodide, containing about 30 mol % or less of silver iodide. The most preferable silver halide is silver bromoiodide or silver chlorobromoiodide, containing about 2 mol % to about 10 mol % of silver iodide.

The silver halide grains contained in the photographic emulsion may be regular crystals such as cubic, octahedral or tetradecahedral crystals, irregular crystals such as spherical tabular crystals, crystals having defects such as crystal twin faces, or those having composite shapes thereof.

The silver halide grains may be fine grains having a grain size of about 0.2 μm or less or large grains having a projected-area diameter of up to 10μm, and the emulsion may be either a polydispersed or mono dispersed emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,499,520, and British Patent 2,112,157.

The crystal structure, which can used in the present invention, may be uniform, may have different halogen compositions in the interior and the surface thereof, or may be a layered structure. Alternatively, a silver halide having a different composition may be joined by an epitaxial junction or a compound except for a silver halide such as silver rhodanide or zinc oxide may be joined. A mixture of grains having various types of crystal shapes may be used.

The emulsion, which can used in the present invention may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion of the present invention is normally subjected to physical ripening, chemical ripening, and spectral sensitization steps before it is used. Additives for use in these steps are described in Research Disclosure Nos. 17,643, 18,716, and 307,105 and they are summarized in the table (later presented).

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver chlorobromide, silver iodobromide, and silver chloroiodobromide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydispersed emulsion, it is preferably a monodispersed emulsion (in which at least 80% in weight or number of silver halide grains have a grain size falling within the range of ±30% of an average grain size).

In the present invention, fine non-light-sensitive silver halide grains are preferably used. "Fine non-light-sensitive silver halide grains" are fine silver halide grains which are not sensitive upon imagewise exposure for obtaining a dye image and essentially not developed in development. The fine non-light-sensitive silver halide grains are preferably not fogged beforehand.

The fine silver halide grains contains 0 to 100 mol % of silver bromide. They may contain silver chloride and/or silver iodide as needed. Preferably, they contain 0.5 to 10 mol % of silver iodide.

An average grain size (an average value of equivalent-circle diameters of projected surface areas) of the fine grain silver halide is preferably 0.01 to 0.5 μm, and more preferably, 0.02 to 0.2 μm.

The fine silver halide grains can be prepared by a method similar to the method of preparing normal light-sensitive material silver halide. In this preparation, the surface of each silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. A layer containing these fine silver halide grains may preferably contain a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three R.D.s, and they are summarized in the following table:

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and | pp. 24–25 | page 649. | pp. 868–870 |

-continued

| Additives | RD17643 | RD18716 | RD307105 |
|---|---|---|---|
| stabilizers | | right column | |
| 6. Light absorbent, filter dye, ultra-violet absorbents | pp. 25–26 | page 649, right column to page 650, left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

It is desirable that the light-sensitive material of the present invention contain the mercapto compounds disclosed in U.S. Pat. Nos. 4,740,454 and 4,788,132, JP-A-62-18539, and JP-A-1-283551.

It is desirable that the light-sensitive material of the present invention contain compounds for releasing a fogging agent, a development accelerator, a silver halide solvent, or precursors thereof described in JP-A-1-106052, regardless of the amount of silver produced by the development.

The light-sensitive material of the present invention preferably contains dyes dispersed by methods described in International Disclosure WO 088/04794 and JP-A-1-502912 or dyes described in EP 317,308A, U.S. Pat. No. 4,420,555, and JP-A-1-259358.

Various color couplers can be used in the present invention. Specific examples of these couplers are described in patents described in above-mentioned Research Disclosure R.D. No. 17643, VII-C to VII-G and R.D. No. 307105, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A.

Examples of a magenta coupler are preferably 5-pyrazolone and pyrazoloazole compounds, and more preferably, the compounds described in, e.g., U.S. Pat. Nos. 4,310,619 and 4,351,897, European Patent 73,636, U.S. Pat. Nos. 3,061,432 and 3,725,067, R.D. No. 24220 (June 1984), JP-A-60-33552, R.D. No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and International Disclosure WO No. 88/04795.

Examples of a cyan coupler are phenol and naphthol couplers. Of these, preferable are those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Laid-open Patent Application 3,329,729, European Patents 121, 365A and 249,453A, U.S. Pat. Nos. 3,446,622, 4,333,999, 4,775,616, 4,451,559, 4,427,767, 4,690,889, 4,254,212, and 4,296,199, and JP-A-61-42658. Also, the pyrazole-series couplers disclosed in JP-A-64-553, JP-A-64-554, JP-A-64-555 and JP-A-64-556, or the imidazole-series couplers disclosed in U.S. Pat. No. 4,818,672 can be used.

Typical examples of a polymerized dye-forming coupler are described in U.S. Pat. Nos. 3,451,820, 4,080,221, 4,367,282, 4,409,320, and 4,576,910, British Patent 2,102,137, and EP 341,188A.

Preferable examples of a coupler capable of forming colored dyes having proper diffusibility are those described in U.S. Pat. No. 4,366,237, British Patent 2,125,570, EP 96,570, and West German Laid-open Patent Application No. 3,234,533.

Preferable examples of a colored coupler for correcting additional, undesirable absorption of a colored dye are those described in R.D. No. 17643, VII-G, R.D. No. 307105, VII-G, U.S. Pat. No. 4,163,670, JP-B-57-39413, U.S. Pat. Nos. 4,004,929 and 4,138,258, and British Patent 1,146,368. A coupler described in U.S. Pat. No. 4,774,181, which corrects unnecessary absorption of a colored dye by virtue of a fluorescent dye released upon coupling, or a coupler described in U.S. Pat. No. 4,777,120, which has, as a split-off group, a dye precursor group which can react with a developing agent to form a dye may preferably be used.

Compounds releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. No. 4,248,962 and 4,782,012.

For example, the couplers which release a bleach accelerator and which are disclosed in R.D. No. 11449, R.D. No. 24241, and JP-A-61-201247 are effective for reducing the time of bleaching process. They are particularly effective if added to a light-sensitive material using the tabular silver halide grains described above. Preferable as a coupler for imagewise releasing a nucleating agent or a development accelerator during the development are the compounds described in British Patents 2,097,140 and 2,131,188, JP-A-59-157638, and JP-A-59-170840. Also preferable are compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, are also preferably.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in European Patents 173,302A and 313,308A; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers for use in the present invention can be added to the light-sensitive material by various known dispersion methods. Examples of these methods are an oil-in-water dispersion method and a latex dispersion method.

Examples of a high-boiling organic solvent to be used in the oil-in-water dispersion method are described in, for example, U.S. Pat. No. 2,322,027. Examples of a high-boiling organic solvent to be used in the oil-in-water dispersion method and having a boiling point of 175° C. or more at atmospheric pressure are phthalate esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate); phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoate esters (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tert-amylphenol), aliphatic carboxylate esters (e.g., bis(2-ethylhexyl) sebacate, dioctylazelate, glyceroltributylate, isostearyllactate, and trioctylcitrate); aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

The steps and effects of the latex dispersion method, and examples of a loadable latex are described in, e.g., U.S. Pat. No. 4,199,363 and German Laid-open Patent Applications (OLS) Nos. 2,541,274 and 2,541,230.

Various types of antiseptics and fungicides are preferably added to the color light-sensitive material of the present invention. Examples of the antiseptics and the fungicides are phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., R.D. No. 17643, page 28, R.D. No. 18716, from the right column, page 647 to the left column, page 648, and R.D. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed T1/2 is preferably 30 sec. or less, and more preferably, 20 sec. or less. The film thickness means a film thickness measured under moisture conditioning at a temperature of 25° C. and a relative humidity of 55% (two days). The film swell speed T1/2 can be measured in accordance with a known method in the art. For example, the film swell speed T1/2 can be measured by using a swell meter described in A. Green et al., "Photographic Science & Engineering," Vol. 19, No. 2, pp. 124 to 129. When 90% of a maximum swell film thickness reached by performing a treatment by using a color developing agent at 30° C. for 3 min. and 15 sec. is defined as a saturated film thickness, T1/2 is defined as a time required for reaching ½ of the saturated film thickness.

The film swell speed T1/2 can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness–film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in R.D. No. 17643, pp. 28 and 29, R.D. No. 18716, the left to right columns, page 651, and R.D. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethyl aniline, 4-amino-3-methyl-N-ethyl-N-(3-hydroxypropyl) aniline is preferred in particular. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine sulfites, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof. The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of the replenisher, a contact area of a processing tank with air is preferably decreased to prevent evaporation and oxidation of the solution upon contact with air.

The contact area of the solution with air in a processing tank can be represented by an aperture defined below.

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediamine-tetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopoly carboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group, described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and R.D. No. 17129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and bromide ions. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of the desilvering step is preferably as short as possible as long as no desilvering defect occurs. A preferable time is 1 to 3 minutes, and more preferably, one to two minutes. A processing temperature is 25° C. to 50° C., and preferably, 35° C. to 45° C. Within the preferable temperature range, a de silvering speed is increased, and generation of a stain after the processing can be effectively prevented.

In the desilvering step, stirring should be performed as strongly as is possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, pp. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an adduct of aldehyde sulfite. Various cheleting agents and fungicides can be added to this stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and R.D. Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in, for example, JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The light-sensitive material according to the present invention can be used as monochrome or color photographic material, as material for making printing plates, as material for laser recording, and as recording material for various uses.

Further, the silver halide photographic light-sensitive material of the present invention can be applied to the thermal developing light-sensitive materials disclosed in, for example, U.S. Pat. No. 4,500,626, JP-A-60-133449, JP-A-59-218443, JP-A-61-238056, and European Patent 210,660A2.

EXAMPLES

The present invention will be described in more detail below by way of its examples. Nonetheless, the present invention is not limited to these examples.

Example 1

Manufacture of Em-A

First, 1,000 ml of an aqueous solution containing 10.5 g of inactive low-molecular gelatin (average molecular weight: 50,000) and 3.0 g of KBr was stirred, while maintained at 30° C. Next, a silver nitrate aqueous solution ($AgNO_3$, 8.2 g) and a potassium bromide aqueous solution (KBr, 5.7 g, KI 0.35 g) were added over 1 minute to the solution containing gelatin and KBr by means of the double-jet method. Then, 21.5 g of deionized gelatin maintained at 90° C. was added to the resultant solution. The solution, thus formed, was heated to 75° C. Thereafter, 14.7N ammonia aqueous solution was added to the solution, adjusting the pH to 8.3. The solution was physically ripened, and 1N nitric acid was added to the solution, thus adjusting the pH to 5.5. Next, a silver nitrate aqueous solution ($AgNO_3$, 165 g) and a halogen aqueous solution (containing KI in an amount of 4.2 mol % based on KBr) were added over 58 minutes, by the double-jet method at an accelerated rate, thereby growing grains. During this addition, the silver potential was held at −25 mV with respect to the saturated calomel electrode employed. Em-A, thus prepared, was desalted by flocculation. Gelatin was added to the emulsion. Thereafter, the pH and pAg values of the emulsion were adjusted to 5.5 and 8.8, respectively. Emulsion Em-A contained tabular grains which had an average aspect ratio of 11.2, an equivalent-sphere diameter of 1.08 μ, and a variation coefficient of 24%.

Manufacture of Em-B to Em-G

Em-B to Em-G were prepared by the same method as Emulsion Em-A, except that the silver potential was held at various values other than −25 mV during the growth of grains. These emulsions, which will be referred to as "Emulsions B, C, D, E, F and G," contained tabular grains having average aspect ratios of 9.5, 7.8, 6.5, 5.0, 3.1, and 2.5, respectively.

Em-A to Em-F were subjected to gold-sulfur sensitization. More specifically, each of these emulsions was heated to 64° C. Next, $7.2\times10^{-4}$ mol/mol Ag of sensitizing dye A specified in Table B (later presented), $1.0\times10^{-4}$ mol/mol Ag of antifoggant A specified in Table B, $8.5\times10^{-6}$ mol/mol Ag of sodium thiosulfate, $1.0\times10^{-5}$ mol/mol ag of chloroauric acid, and $1.0\times10^{-3}$ mol/mol Ag of potassium thiocyanate were sequentially added to the emulsion, thereby performing optimal chemical sensitization on each emulsion. The term "optimal chemical sensitization" means a chemical sensitization which makes the emulsion have a maximum sensitivity when exposed to light for 1/100 second.

Also, Em-A to Em-F were subjected to gold-sulfur-tellurium sensitization. More specifically, each of these emulsions was heated to 64° C. Next, $7.2\times10^{-4}$ mol/mol Ag of sensitizing dye A specified in Table B (later presented), $1.0\times10^{-4}$ mol/mol Ag of antifoggant A specified in Table B, $7.1\times10^{-6}$ mol/mol Ag of sodium thiosulfate, $1.5\times10^{-5}$ mol/mol ag of chloroauric acid, $2.5\times10^{-3}$ mol/mol Ag of potassium thiocyanate, and $2.2\times10^{-6}$ mol/mol Ag of butyldiisopropyl phosphinetelluride were sequentially added to the emulsion, thereby performing optimal chemical sensitization on each emulsion.

Each resultant emulsion was coated on a triacetylcelluose film support, thus forming en emulsion layer, and a protective layer was then formed on the emulsion layer, thereby preparing a sample. As a result, Samples 101 to 114 were formed. The composition of the emulsion layer and that of the protective layer were as follows:

| | |
|---|---|
| (1) Emulsion Layer | |
| Emulsion selected | (silver: $2.1\times10^{-2}$ mol/m$^2$) |
| Coupler (Table B) | ($1.5\times10^{-3}$ mol/m$^2$) |
| Tricresylphosphate | (1.10 g/m$^2$) |
| Gelatin | (2.30 g/m$^2$) |
| (2) Protective Layer | |
| 2,4-dichloro-6-hydroxy-S-triazine sodium salt | (0.08 g/m$^2$) |
| Gelatin | (1.80 g/m$^2$) |

Samples 101 to 114 were left to stand for 14 hours at 40° C. and relative humidity of 70%. Then, they were exposed to light for 1/100 second, said light applied through a gelatin filter (i.e., filter SC50 made by Fuji Film) and also through a continuous wedge. Samples 101 to 114 were color-developed under the conditions which will be specified below. The developed samples were subjected to density measurement by using a green filter.

| Processing Step | Time | Temperature |
|---|---|---|
| Color developing | 2 min. 00 sec. | 40° C. |
| Bleaching | 3 min. 00 sec. | 40° C. |
| Water-washing (1) | 20 sec. | 35° C. |
| Water-washing (2) | 20 sec. | 35° C. |
| Stabilizing | 20 sec. | 35° C. |
| Drying | 50 sec. | 65° C. |

The solutions used in the processing steps specified above had the following compositions:

| | (g) |
|---|---|
| (Color developing solution) | |
| Diethylenetriaminepentaacetic acid | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxyamine sulfate | 2.4 |
| 4-(N-ethyl-N-β-hydroxyethylamino)-2-methylaniline sulfate | 4.5 g |
| Water to make | 1.0 liter |
| pH | 10.05 |
| (Bleach-fixing solution) | |
| Ferric ammonium ethylenediamine tetraacetate (dihydrate) | 90.0 |
| Disodium ethylenediamine tetra-acetate | 5.0 |
| Sodium sulfite | 12.0 |
| Ammonium thiosulfate aqueous solution (70%) | 260.0 ml |
| Acetic acid (98%) | 5.0 ml |
| Bleach accelerator (Table B) | 0.01 mol |
| Water to make | 1.0 liter |
| pH | 6.0 |

Water-washing solution

This was a solution prepared as follows. First, tap water was passed through a mixed-bed column filled with OH-type strong-base anion exchange resin (Amberlite IR-400)and H-type strong-acid cation exchange resin (Amberlite IR-120B), both resins manufactured by Rohm and Haas, Inc., whereby the calcium and magnesium ion concentration of the water was reduced to 3 mg/l or less. Next, 20 mg/l of sodium isocyanuric dichloride and 1.5 g/l of sodium sulfate were added to the water thus processed, thereby obtaining the washing solution. The washing solution had a pH value ranging from 6.5 to 7.5.

| (Stabilizing Solution) | (g) |
|---|---|
| Formalin (37%) | 2.0 ml |
| Polyoxyethylene-p-monononylphenylether (average polymerization degree: 10) | 0.3 |
| Disodium ethylenediamine tetraacetate | 0.05 |
| Water to make | 1.0 liter |
| pH | 5.0 to 8.0 |

The sensitivity of each sample was evaluated in a relative manner, with the sensitivity (100) of Sample 101 used as a reference, said relative value being the reciprocal of the exposure amount represented in terms of lux-second which imparted a density of fog +0.2.

The pressure property of each sample was evaluated by the following method. The sample was wound around a rod having a diameter of 6 mm, with its emulsion-coated surface turned inwards, and maintained in this condition for 10 seconds. Thereafter, the sample was wedge-exposed for 1/100 second under the same conditions as described above. The density of the sample was then measured, with the density (100) of Sample 101, not wound, used as reference.

The graininess of each sample was evaluated in the following way. The sample was uniformly exposed to light until it gained a density of fog +0.5, and developed in the same method as described above. The RMS graininess of the sample was measured by the method disclosed in "The Theory of the Photographic Process," Macmillan, page 619, with that (100) of Sample 101 used as reference. The smaller the numerical value, the better the graininess.

The properties of Samples 101 to 114, thus evaluated, were as is shown in Table 1 (later presented).

As is evident from Table 1, the tellurium sensitization according to this invention serves to provide an emulsion which has high sensitivity and excels in graininess. It is also understood that an emulsion containing tabular grains having an aspect ratio of 3 or more had not only high sensitivity and excellent graininess, but also improved pressure property.

Example 2

Gold-sulfur sensitization, to be compared with the present invention, was performed on Em-A, Em-C, Em-F, and Em-G, all prepared in Example 1. To be more specific, each of these emulsions was heated to 68° C., and $1.4\times10^{-4}$ mol/mol Ag of sensitizing dye B, $4.1\times10^{-5}$ mol/mol Ag of sensitizing dye C, $6.1\times10^{-4}$ mol/mol Ag of sensitizing dye D (dyes B, C and D being specified in Table C presented later), $1.2\times10^{-4}$ mol/mol Ag of antifoggant A, $8.1\times10^{-6}$ mol/mol Ag of sodium thiosul fate, $1.3\times10^{-5}$ mol/mol Ag of chloroauric acid, and $1.0\times10^{-3}$ mol/mol Ag of of potassium thiocyanate were sequentially added to the heated emulsion, thus chemically sensitizing the emulsion optimally. The resultant four emulsions will be referred to as Em-1, Em-2, Em-3, and Em-4, respectively.

Also, gold-sulfur-tellurium sensitization was performed on Em-A, Em-C, Em-F, and Em-G. More specifically, each of these emulsions was heated to 68° C., and $4.2\times10^{-4}$ mol/mol Ag of sensitizing dye B, $1.4\times10^{-4}$ mol/mol Ag of sensitizing dye C, $2.3\times10^{-4}$ mol/mol Ag of sensitizing dye D, $1.2\times10^{-4}$ mol/mol Ag of antifoggant A, $7.4\times10^{-6}$ mol/mol Ag of sodium thiosulfate, $2.0\times10^{-5}$ mol/mol Ag of chloroauric acid, $2.0\times10^{-3}$ mol/mol Ag of potassium thiocyanate, and $2.0\times10^{-6}$ mol/mol Ag of N,N-dimethyl tellurourea were sequentially added to the heated emulsion, thus chemically sensitizing the emulsion optimally. The resultant four emulsions will be referred to as Em-5, Em-6, Em-7, and Em-8, respectively.

A plurality of layers having the following compositions were coated on an undercoated triacetylcellulose film support, forming a multilayered color light-sensitive material hereinafter referred to as "Sample 201".

Compositions of light-sensitive layers

Numerals corresponding to each component indicate a coating amount represented in units of g/m$^2$. The coating amount of a silver halide is represented by the coating amount of silver. The coating amount of a sensitizing dye is represented in units of moles per mole of a silver halide in the same layer.

| | |
|---|---|
| Layer 1 (Antihalation layer) | |
| Black colloidal silver | silver0.20 |
| Gelatin | 1.40 |
| Layer 2 (Interlayer) | |
| 2,5-di-t-pentadecylhydroquinone | 0.18 |
| EX-1 | 0.18 |
| EX-3 | 0.020 |
| EX-12 | $2.0\times10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Layer 3 (1st red-sensitive emulsion layer) | |
| Emulsion I | silver0.30 |
| Emulsion II | silver0.20 |
| Sensitizing dye I | $6.5\times10^{-5}$ |
| Sensitizing dye I | $1.8\times10^{-5}$ |
| Sensitizing dye III | $2.7\times10^{-4}$ |
| EX-2 | 0.17 |
| EX-10 | 0.020 |
| EX-4 | 0.17 |
| U-1 | 0.070 |
| U-2 | 0.050 |
| U-3 | 0.070 |
| HBS-1 | 0.060 |
| Gelatin | 0.87 |
| Layer 4 (2nd red-sensitive emulsion layer) | |
| Emulsion VI | silver1.20 |
| Sensitizing dye I | $5.1\times10^{-5}$ |
| Sensitizing dye II | $1.4\times10^{-5}$ |
| Sensitizing dye III | $2.3\times10^{-4}$ |
| EX-2 | 0.25 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Layer 5 (3rd red-sensitive emulsion layer) | |
| Emulsion Em-1 | silver1.30 |
| EX-2 | 0.087 |
| EX-3 | 0.010 |
| EX-4 | 0.075 |
| HBS-1 | 0.22 |
| HBS-2 | 0.10 |
| Gelatin | 1.63 |
| Layer 6 (Interlayer) | |
| EX-5 | 0.040 |
| HBS-1 | 0.020 |
| Gelatin | 0.80 |

| | |
|---|---|
| Layer 7 (1st green-sensitive emulsion layer) | |
| Emulsion I | silver0.15 |
| Emulsion II | silver0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| Ex-7 | 0.030 |
| Ex-8 | 0.025 |
| HBS-1 | 0.10 |
| HBS-3 | 0.010 |
| Gelatin | 0.63 |
| Layer 8 (2nd green-sensitive emulsion layer) | |
| Emulsion III | silver0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| Ex-7 | 0.026 |
| Ex-8 | 0.018 |
| HBS-1 | 0.16 |
| HBS-3 | $8.0 \times 10^{-3}$ |
| Gelatin | 0.50 |
| Layer 9 (3rd green-sensitive emulsion layer) | |
| Emulsion IV | silver1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| Ex-11 | 0.065 |
| Ex-13 | 0.019 |
| HBS-1 | 0.25 |
| HBS-2 | 0.10 |
| Gelatin | 1.54 |
| Layer 10 (Yellow filter layer) | |
| Yellow colloidal silver | silver0.050 |
| EX-5 | 0.080 |
| HBS-1 | 0.030 |
| Gelatin | 0.95 |
| Layer 11 (1st blue-sensitive emulsion layer) | |
| Emulsion I | silver0.080 |
| Emulsion II | silver0.070 |
| Emulsion V | silver0.070 |
| Sensitizing dye VII | $3.5 \times 10^{-4}$ |
| EX-8 | 0.042 |
| Ex-9 | 0.72 |
| HBS-1 | 0.28 |
| Gelatin | 1.10 |
| Layer 12 (2nd blue-sensitive emulsion layer) | |
| Emulsion VI | silver0.45 |
| Sensitizing dye VII | $2.1 \times 10^{-4}$ |
| EX-9 | 0.15 |
| Ex-10 | $7.0 \times 10^{-3}$ |
| HBS-1 | 0.050 |
| Gelatin | 0.78 |
| Layer 13 (3rd blue-sensitive emulsion layer) | |
| Emulsion VII | silver0.77 |
| Sensitizing dye VII | $2.2 \times 10^{-4}$ |
| EX-9 | 0.20 |
| HBS-1 | 0.070 |
| Gelatin | 0.69 |
| Layer 14 (1st protective layer) | |
| Emulsion VIII | silver0.20 |
| U-4 | 0.11 |
| U-5 | 0.17 |

| | |
|---|---|
| HBS-1 | $5.0 \times 10^{-2}$ |
| Gelatin | 1.00 |
| Layer 15 (2nd protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, all layers of Sample 1 contained W-1, W-2, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rhodium salt, so that they may have improved storage stability, may be more readily processed, may be more resistant to pressure, more antibacterial and more antifungal, may be better protected against electrical charging, and may be more readily coated.

The emulsions identified by the above abbreviations will be specified in Table 2 presented later, and the compounds identified by the above abbreviations will be specified in Table D presented later.

Samples 202 to 208 were made by the same method as Sample 201, except that Em-2 to Em-8 were used in place of Em-1 used in Sample 201.

Samples 201 to 208 were exposed to light and processed by an automatic developing machine, in the method specified below, until the quantity of replenisher reached three times the volume of the mother solution tank.

| Processing Method | | | | |
|---|---|---|---|---|
| | | | Quantity* of Tank | |
| Process | Time | Temp. | replenisher | volume |
| Color development | 3 min. 15 sec. | 37.8° C. | 25 ml | 10 l |
| Bleaching | 45 sec. | 38° C. | 5 ml | 4 l |
| Bleach-fixing (1) | 45 sec. | 38° C. | — | 4 l |
| Bleach-fixing (2) | 45 sec. | 38° C. | 30 ml | 4 l |
| Washing (1) | 20 sec. | 38° C. | — | 2 l |
| Washing (2) | 20 sec. | 38° C. | 30 ml | 2 l |
| Stabilization | 20 sec. | 38° C. | 20 ml | 2 l |
| Drying | 1 min. | 55° C. | | |

*Note: The quantity of replenisher is per meter of a 35-mm wide sample.

In the color-developing process specified above, the bleach-fixing steps and the washing steps were carried out in counter flow. In other words, the step (1) was performed after the step (2). Further, the overflowing part of the bleaching solution was all used in the bleach-fixing (2).

This overflowing part of the bleaching solution amounted to 2 ml per meter in the case of the 35-mm wide sample.

The compositions of the solutions used in the color-developing process are as follows:

| | Mother Solution (g) | Replenishment Solution (g) |
|---|---|---|
| (Color Developing Solution) | | |
| Diethylenetriaminepentaacetic acid | 5.0 | 6.0 |
| Sodium sulfide | 4.0 | 5.0 |
| Potassium carbonate | 30.0 | 37.0 |
| Potassium bromide | 1.3 | 0.5 |

-continued

| | Mother Solution (g) | Replenishment Solution (g) |
|---|---|---|
| Potassium iodide | 1.2 mg | — |
| Hydroxylamine sulfate | 2.0 | 3.6 |
| 4-[N-ethyl-N-β-hydroxylethyl-amino]-2-methylaniline sulfate | 4.7 | 6.2 |
| water to make | 1.0 liter | 1.0 liter |
| pH | 10.00 | 10.15 |
| (Bleaching Solution) | | |
| Ferric ammonium 1,3-diamino-propane tetraacetate (mono-hydrate) | 144.0 | 206.0 |
| 1,3-diaminopropanetetraacetic acid | 2.8 | 4.0 |
| Ammonium bromide | 84.0 | 120.0 |
| Ammonium nitrate | 17.5 | 25.0 |
| Ammonia water (27%) | 10.0 | 1.8 |
| Acetic acid (98%) | 51.1 | 73.0 |
| Water to make | 1.0 liter | 1.0 liter |
| pH | 4.3 | 3.4 |
| (Bleach-Fixing Solution) | | |
| Ferric ammonium ethylene-diamine tetraacetate (dihydrate) | 50.0 | — |
| Disodium ethylenediamine tetraacetate | 5.0 | 25.0 |
| Sodium sulfite | 12.0 | 20.0 |
| Ammonium thiosulfate aqueous solution (700 g/l) | 290.0 ml | 320.0 ml |
| Ammonia Water (27%) | 6.0 ml | 15.0 ml |
| Water to make | 1.0 liter | 1.0 liter |
| pH | 6.8 | 8.0 |

Washing Solution

The mother solution and the replenisher were of the same composition.

This was a solution prepared as follows. First, tap water was passed through a mixed-bed column filled with OH-type strong-base anion exchange resin (Amberlite IR-400) and H-type strong-acid cation exchange resin (Amberlite IR-120B), both resins made by manufactured by Rohm and Haas, Inc., whereby the calcium and magnesium ion concentration of the water was reduced to 3 mg/l or less. Next, 20 mg/l of sodium dichloroisocyanurate and 1.5 g/l of sodium sulfate were added to the water thus processed, thereby obtaining the washing solution. The washing solution had a pH value ranging from 6.5 to 7.5.

| (Stabilizing Solution) | (g) |
|---|---|
| The mother solution and the replenisher were of the same composition | |
| Formalin (37%) | 1.2 ml |
| Surfactant ($C_{10}H_{21}$—O—$(CH_2CH_2O)_{10}$—H) | 0.4 g |
| Ethylene glycol | 1.0 g |
| Water to make | 1.0 l |
| pH | 5.1 to 7.0 |

The sensitivity of each sample was measured in terms of relative value of the fog density determined from a cyan-image characteristic curve and the relative value of the reciprocal of the exposure amount which imparted a density 0.1 higher than the fog density.

The sensitivity was evaluated in terms of a relative value, with the density (100) of Sample 201 used as reference.

The samples were tested in the same way as in Example 1, for their graininesses and pressure properties. The graininess of each sample was represented in a relative value, with the graininess (100) of Sample 201 used as reference. Of the pressure properties, the sensitivity of each sample was represented in a relative value, using as reference the sensitivity (100) of Sample 201 not bent.

The evaluation results on Samples 201 to 208 were as is shown in Table 3 which will be presented later. As is evident from Table 3, the emulsions of the present invention had a high sensitivity and excelled in graininess and pressure property.

Example 3

Manufacture of Em-H1

First, 1,000 ml of an aqueous solution containing 10.5 g of gelatin and 3.0 g of KBr was stirred, while maintained at 58° C. Next, a silver nitrate aqueous solution ($AgNO_3$, 8.2 g) and a halogenide aqueous solution (KBr, 5.7 g, and KI 0.28 g) were added over 1 minute to the solution containing gelatin and KBr by means of a double-jet method. Then, 21.5 g of gelatin was added to the resultant solution. The solution, thus formed, was heated to 75° C. Thereafter, a silver nitrate aqueous solution ($AgNO_3$, 136.3 g) and a halogen aqueous solution (containing KI in an amount of 4.2 mol % based on KBr) were added to the solution over 51 minutes, by a double-jet method at an accelerated flow rate. During this addition, the silver potential was held at 0 mV with respect to the saturated calomel electrode employed. The solution was cooled to 40° C. Then, a silver nitrate aqueous solution ($AgNO_3$, 28.6 g) and a KBr aqueous solution were added to the solution over 5.35 minutes by means of a double-jet method, thereby forming an emulsion. During this addition, the silver potential was held at −50 mV with respect to the saturated calomel electrode. The emulsion, thus prepared, was desalted by flocculation. Gelatin was added to the emulsion. Thereafter, the pH and pAg values of the emulsion were adjusted to 5.5 and 8.8, respectively. This emulsion, Em-H1, contained tabular grains which had an equivalent-circle diameter of 1.14 μm, an average thickness of 0.189 μm, an average aspect ratio of 5.9, and a variation coefficient of 28% in terms of equivalent-circle diameter.

Manufacture of Em-H2

Emulsion Em-H2 was prepared in the same way as Em-H1, until the second portion of silver nitrate aqueous solution was added to the solution, then the solution was cooled to 40° C. Next, a silver nitrate aqueous solution ($AgNO_3$, 3.0 g) and an KI aqueous solution (KI, 2.5 g) were added to the solution over 5 minutes. Then, a silver nitrate aqueous solution ($AgNO_3$, 25.4 g) and a KBr aqueous solution were added to the solution over 5.35 minutes by means of a double-jet method. During this addition, the silver potential was held at −50 mV with respect to the saturated calomel electrode. After the flocculation, the solution was processed in the same way as in the preparation of Em-H1, thereby forming Emulsion Em-H2. Em-H1 contained tabular grains which had an equivalent-circle diameter of 1.12 μm, an average thickness of 0.19 μm, an average aspect ratio of 5.9, and a variation coefficient of 29% in terms of equivalent-circle diameter.

Figure 2:
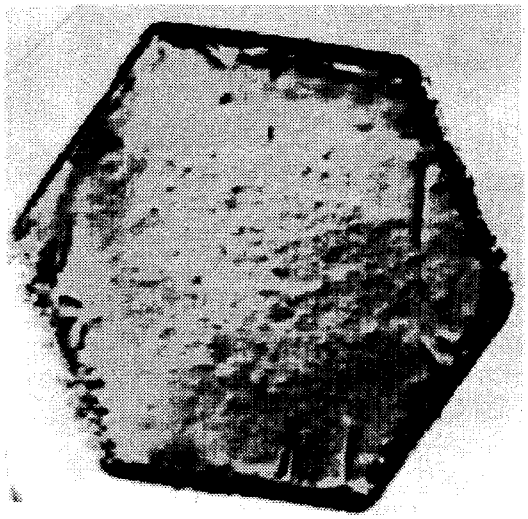
FIG. 2 is an electron-microscope photograph of the typical silver halide grains contained in the emulsion Em-H2 prepared in Example 3.

Em-H1 and Em-H2 were examined at liquid-nitrogen temperature by means of a 200 kV transmission electron microscope. Em-H1 was found to contain grains, most of which had no dislocation lines. On the other hand, Em-H2 was found to contain grains, each of which had many dislocation lines in its entire periphery. Although the dislocation lines in each grain of EM-H2 could not be counted, it was obvious that each grain had ten or more dislocation lines. FIGS. 1 and 2 are photographs representing Em-H1 and Em-H2, respectively. As can be clearly seen in FIGS. 1 and 2, dislocation lines existed in Em-H2, whereas no dislocation lines had been introduced into Em-H1.

Manufacture of Em-I1 to Em-K1

Three emulsions were prepared by the same method as Em-H1, except that the silver potential was held at various values other than −50 mV during the growth of grains. These emulsions, which will be referred to as "Em-I1," "Em-J1," and "Em-K1," respectively, contained tabular grains having average aspect ratios of 7.9, 3.8, and 2.7, respectively.

Manufacture of Em-I2 to Em-K2

Three emulsions were prepared by the same method as Em-H2, except that the silver potential was held at various values other than −50 mV during the growth of grains. These emulsions, which will be referred to as "Em-I2," "Em-J2," and "Em-K2," respectively, contained tabular grains having average aspect ratio of 7.9, 3.8 and 2.7, respectively.

Emulsions Em-H1, Em-I1, and Em-K1, thus prepared, were subjected to gold-sulfur sensitization. More specifically, each of these emulsions was heated to 72° C. Next, $7\times10^{-5}$ mol/mol Ag of antifoggant A used in Example 1, $1.1\times10^{-5}$ mol/mol Ag of sodium thiosulfate, $1.0\times10^{-5}$ mol/mol Ag of chloroauric acid, and $8.0\times10^{-4}$ mol/mol Ag of potassium thiocyanate were sequentially added to the emulsion, in the presence of the sensitizing dye A used in Example 1, thereby performing optimal chemical sensitization on each emulsion. The term "optimal chemical sensitization" means a chemical sensitization in which the sensitizing dye was used in such an amount and the solution was sensitized for such a time, that the resultant emulsion will have a maximum sensitivity when exposed to light for 1/100 second.

Also, Emulsions Em-H2, Em-I2, and Em-K2 were subjected to gold-sulfur-tellurium sensitization. More specifically, each of these emulsions was heated to 72° C. Next, $1.0\times10^{-4}$ mol/mol Ag of antifoggant A used in Example 1, $1.0\times10^{-5}$ mol/mol Ag of sodium thiosulfate, $1.5\times10^{-5}$ mol/mol ag of chloroauric acid, $2.4\times10^{-3}$ mol/mol Ag of potassium thiocyanate, and $1.0\times10^{-5}$ mol/mol Ag of butyl-diisopropyl phosphinetelluride were sequentially added to the emulsion, in the presence of the sensitizing dye A used in Example 1, thereby performing optimal chemical sensitization on each emulsion.

The emulsions, thus prepared, were coated in the same way as in Example 1, hereby forming Samples 301 to 316. These samples were tested for their photographic properties.

The sensitivity of each sample was indicated in a relative value, using as reference the sensitivity (100) of Sample 301 not bent.

The graininess of each sample was represented in a relative value, with the graininess (100) of Sample 301 used as reference.

The evaluation results on Samples 301 to 316 were as is shown in Table 4 which will be presented later.

As is evident from Table 4, the emulsions of the present invention, which had been tellurium-sensitized, had a high sensitivity and excelled in graininess, and had an improved pressure property.

In particular, the emulsion, into which dislocation had been introduced, had its pressure property greatly improved by virtue of the tellurium sensitization according to the present invention.

As has been described in detail, the present invention greatly helps to provide a silver halide photo graphic light-sensitive material which excels in sensitivity/graininess ratio and had an improved pressure property.

TABLE A

| | |
|---|---|
| 1. | $(nC_4H_9)_3P{=}Te$ |
| 2. | $(tC_4H_9)_3P{=}Te$ |
| 3. | 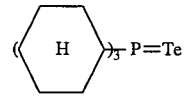 |
| 4. | $((i)C_3H_7)_3P{=}Te$ |
| 5. | 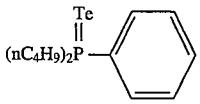 |
| 6. | 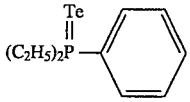 |
| 7. | $((i)C_4H_9)_3P{=}Te$ |
| 8. | $((i)C_4H_9)_2P(Te)C_4H_9(n)$ |
| 9. | $(i)C_3H_7P(C_4H_9(n))_2(Te)$ |
| 10. | $((i)C_3H_7)_2P(Te)C_4H_9(n)$ |
| 11. | $(i)C_3H_7P(C_4H_9(i))_2(Te)$ |
| 12. | $((i)C_3H_7)_2P(Te)C_4H_9(i)$ |
| 13. | $((i)C_3H_7)_2P(Te)C_8H_{17}(n)$ |
| 14. | $C_2H_5P(Te)(OC_2H_5)_2$ |
| 15. | $(nC_4H_9O)_3P{=}Te$ |
| 16. | $C_2H_5P(Te)(N(CH_3)_2)_2$ |
| 17. | 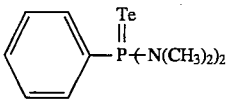 |
| 18. | $((CH_3)_2N)_3P{=}Te$ |
| 19. | $((CH_3)_3SiO)_2P(Te)H$ |
| 20. | 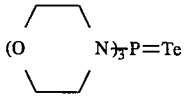 |
| 21. | $(C_2H_5)_2P(Te)N(C_2H_5)_2$ |

TABLE A-continued
22.
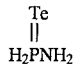
23.
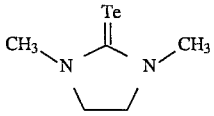
24.
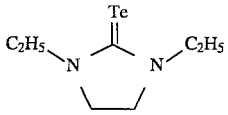
25.
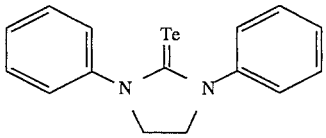
26.
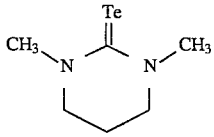
27.
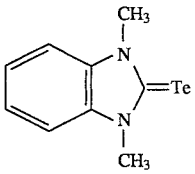
28.
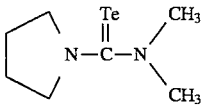
29.
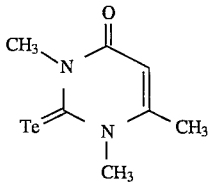
30.
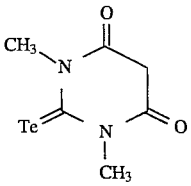
31.
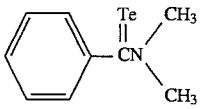
32.
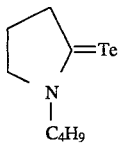
TABLE A-continued
33.
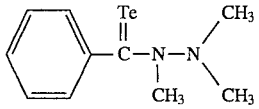
34.
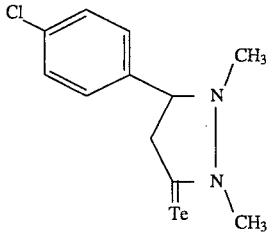
35.
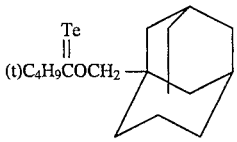
36.
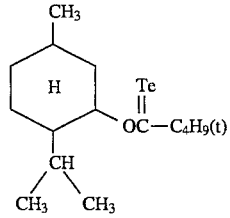
37.
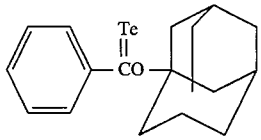
38.
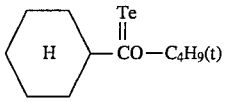

TABLE B
Sensitizing dye A
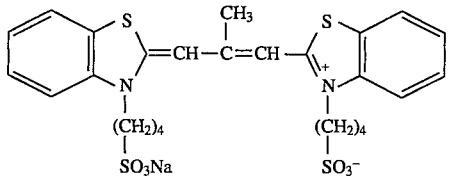
A
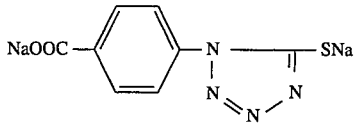
Coupler
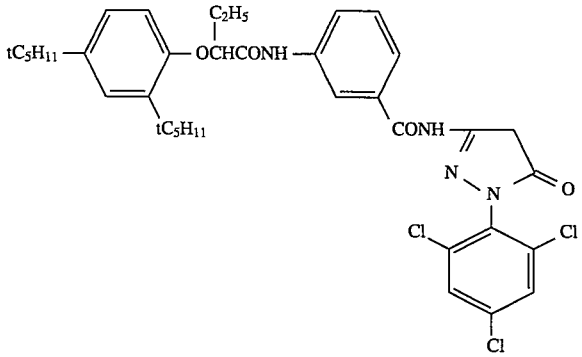
TABLE C
Sensitizing dye B
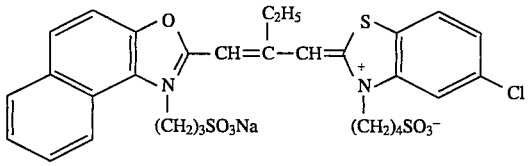
Sensitizing dye C
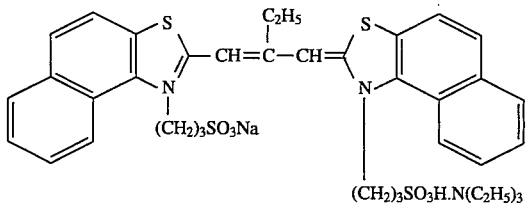
Sensitizing dye D
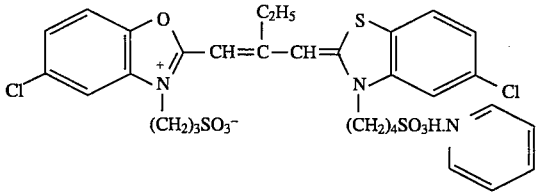

TABLE D
EX-1
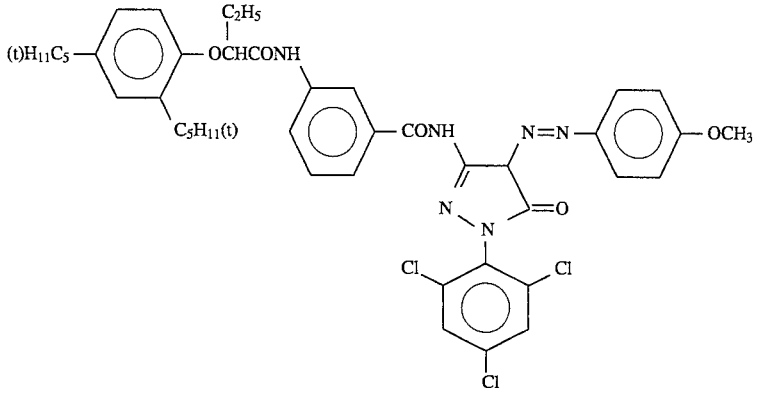
EX-2
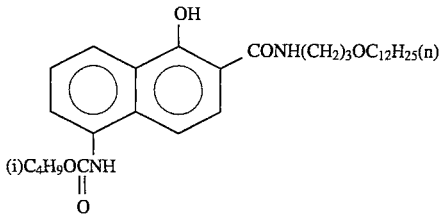
EX-3
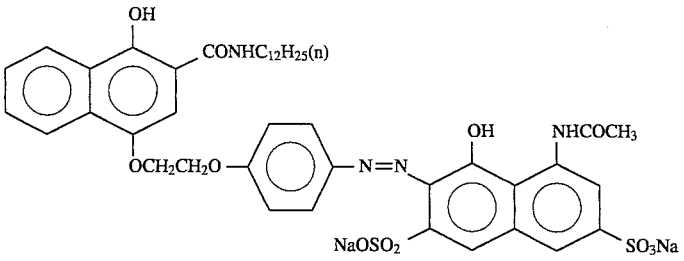
EX-4
EX-5
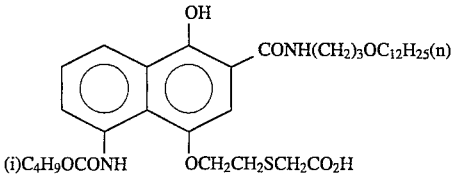
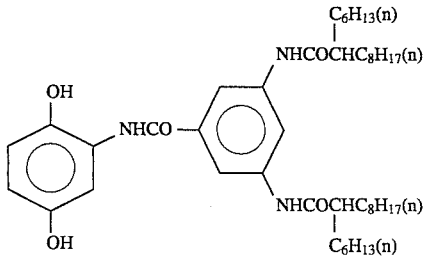
EX-6
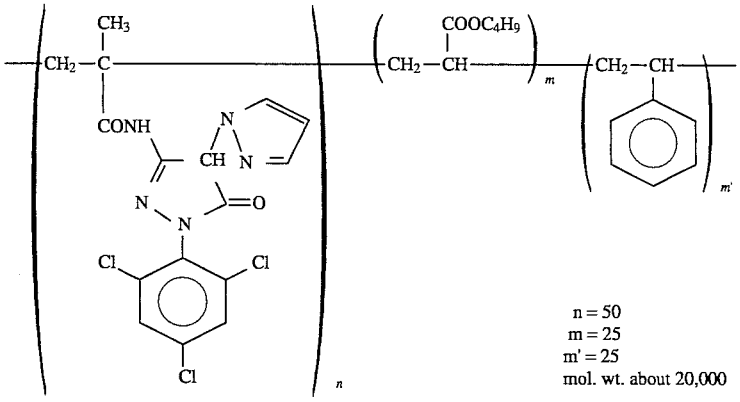
n = 50
m = 25
m' = 25
mol. wt. about 20,000

TABLE D-continued
EX-7
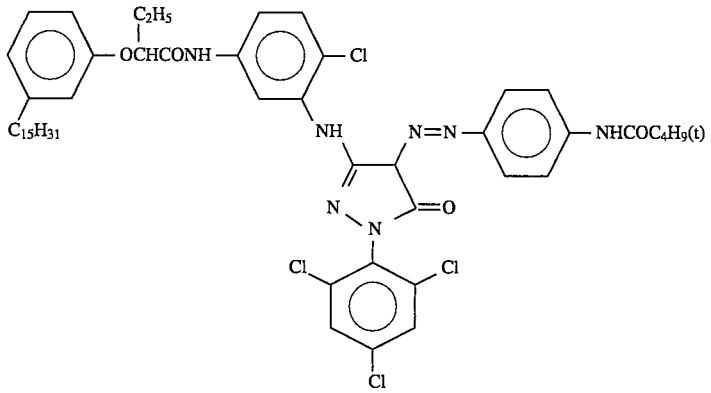
EX-8
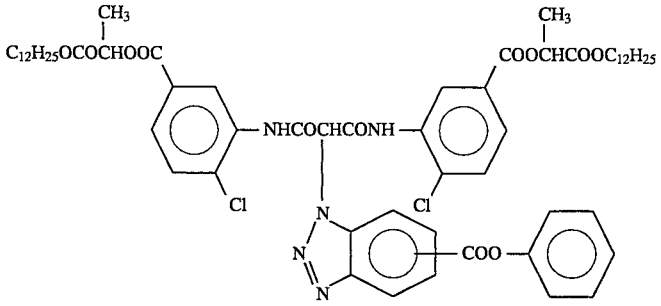
EX-9
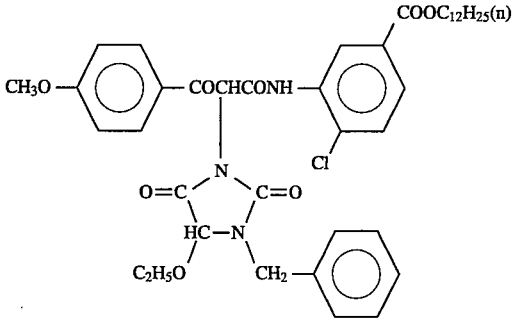
EX-10
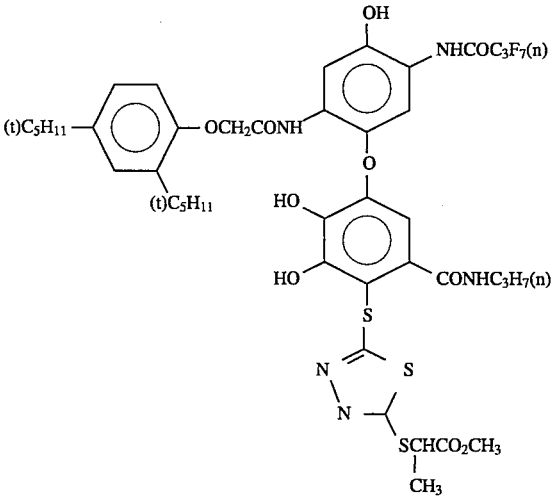

TABLE D-continued
EX-11
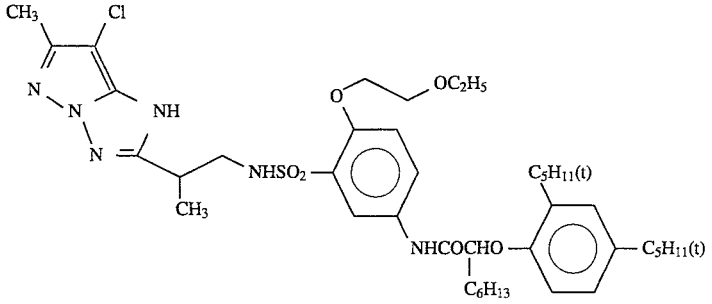
EX-12
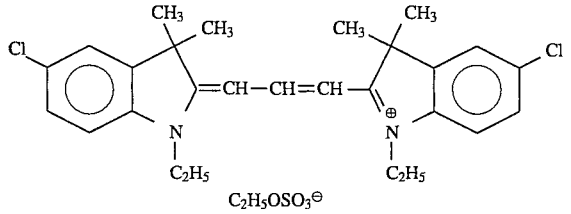
EX-13
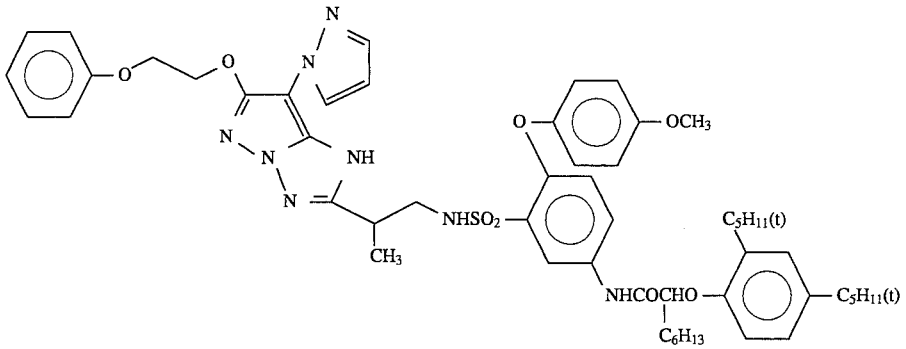
EX-14
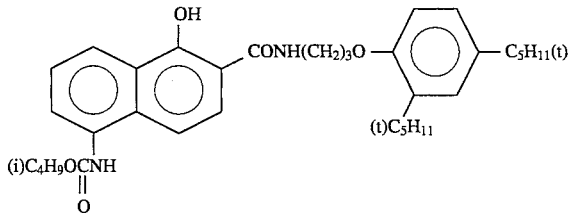
EX-15
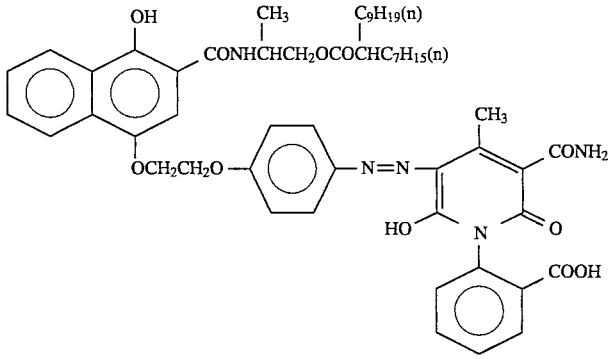
U-1
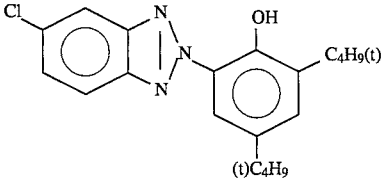
U-2
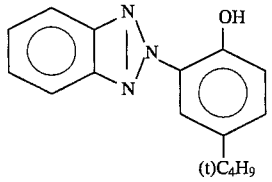

TABLE D-continued
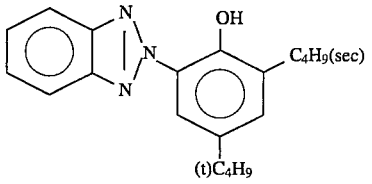
U-3
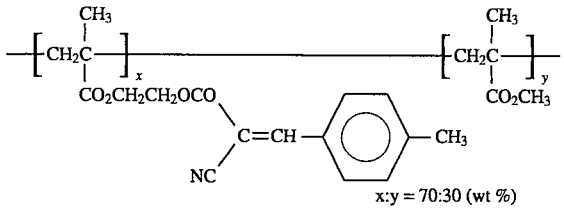
U-4
x:y = 70:30 (wt %)
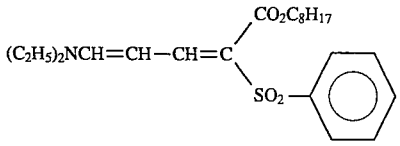
U-5 Tricresylphosphate
HBS-1
Di-n-butylphthalate
HBS-2
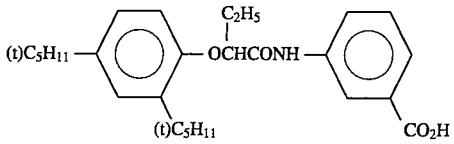
HBS-3
Sensitizing dye I
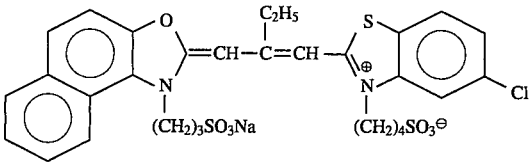
Sensitizing dye II
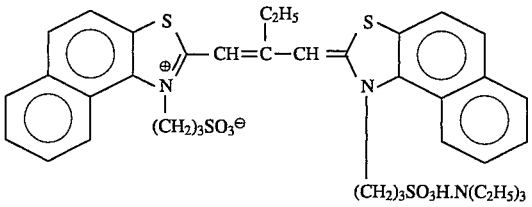
Sensitizing dye III
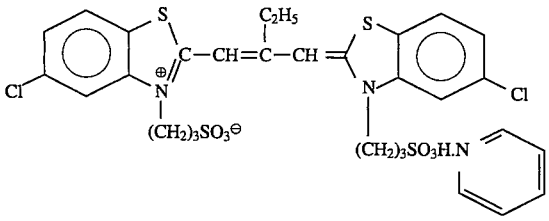
Sensitizing dye IV
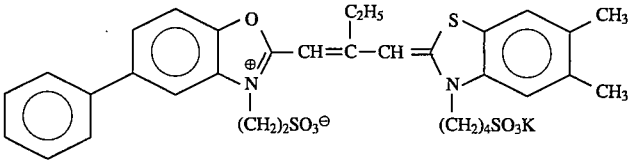
Sensitizing dye V
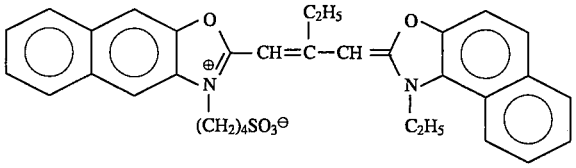

TABLE D-continued
Sensitizing dye VI
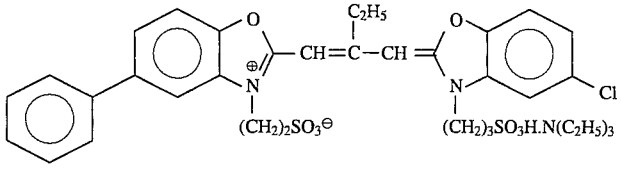
Sensitizing dye VII
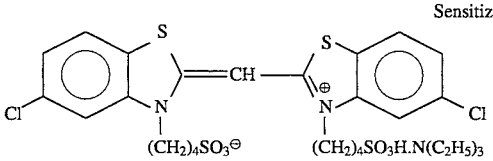
S-1
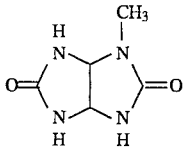
$CH_2=CH-SO_2-CH_2-CONH-CH_2$
$CH_2=CH-SO_2-CH_2-CONH-CH_2$
H-1
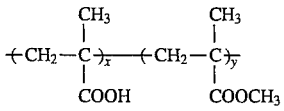
x/y = 10/90
B-1
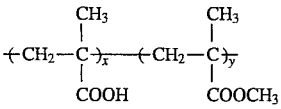
x/y = 40/60
B-2
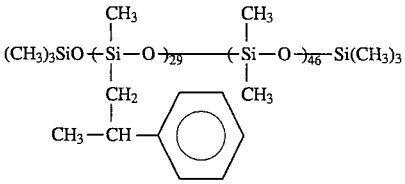
B-3
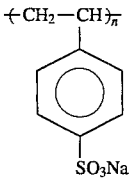
B-4
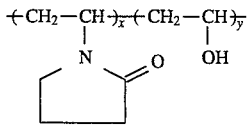
x/y = 70/30
B-5
$C_8F_{17}SO_2NHCH_2CH_2CH_2OCH_2CH_2\overset{\oplus}{N}(CH_3)_3$
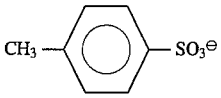
W-1
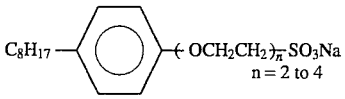
W-2
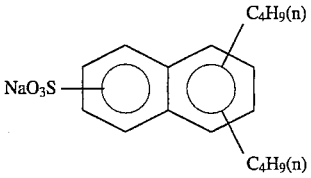
W-3
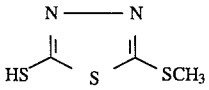
F-1
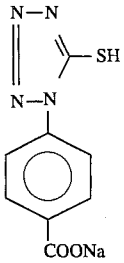
F-2
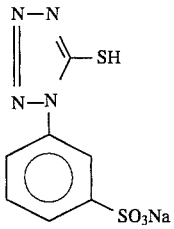
F-3
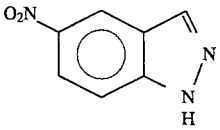
F-4
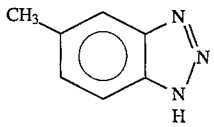
F-5

TABLE D-continued

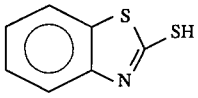

F-6

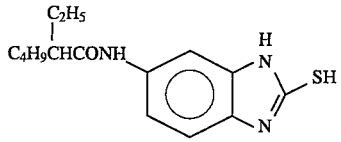

F-7

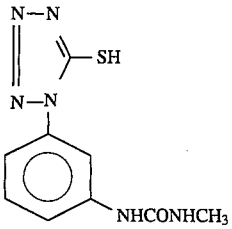

F-8

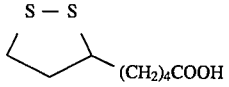

F-9

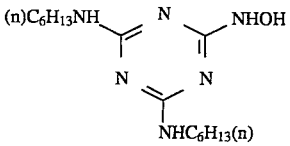

F-10

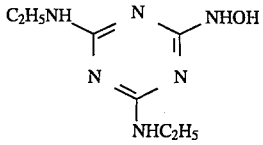

F-11

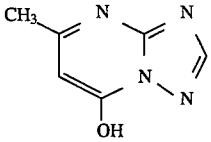

F-12

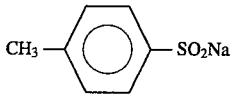

F-13

TABLE 1

| Sample No. | Emulsion | Average aspect ratio | Chemical sensitization | Sensitivity | Fog | After bending Sensitivity | After bending Fog | Graininess |
|---|---|---|---|---|---|---|---|---|
| 101 (Comparative Example) | Em-A | 11.2 | Gold-sulfur | 100 | 0.17 | 75 | 0.40 | 100 |
| 102 (Present Invention) | " | " | Gold-sulfur-tellurium | 135 | 0.18 | 130 | 0.31 | 101 |
| 103 (Comparative Example) | Em-B | 9.5 | Gold-sulfur | 97 | 0.16 | 85 | 0.37 | 98 |
| 104 (Present Invention) | " | " | Gold-sulfur-tellurium | 133 | 0.17 | 129 | 0.30 | 100 |
| 105 (Comparative Example) | Em-C | 7.8 | Gold-sulfur | 92 | 0.16 | 85 | 0.35 | 97 |
| 106 (Present Invention) | " | " | Gold-sulfur-tellurium | 129 | 0.16 | 127 | 0.27 | 100 |
| 107 (Comparative Example) | Em-D | 6.5 | Gold-sulfur | 89 | 0.17 | 82 | 0.32 | 97 |
| 108 (Present Invention) | " | " | Gold-sulfur-tellurium | 127 | 0.16 | 125 | 0.25 | 95 |
| 109 (Comparative Example) | EM-E | 5.0 | Gold-sulfur | 83 | 0.16 | 77 | 0.28 | 98 |
| 110 (Present Invention) | " | " | Gold-sulfur-tellurium | 119 | 0.15 | 118 | 0.24 | 96 |
| 111 (Comparative Example) | EM-F | 3.1 | Gold-sulfur | 75 | 0.15 | 72 | 0.23 | 99 |
| 112 (Present Invention) | " | " | Gold-sulfur-tellurium | 104 | 0.15 | 104 | 0.21 | 100 |
| 113 (Comparative Example) | Em-G | 2.5 | Gold-sulfur | 70 | 0.14 | 68 | 0.20 | 92 |
| 114 (Comparative Example) | " | " | Gold-sulfur-tellurium | 88 | 0.15 | 88 | 0.20 | 103 |

TABLE 2

| | Average AgI content (%) | Average grain size (μm) | Variation coefficient in terms of grain size (%) | Diameter thickness ratio, | Silver amount ratio (AgI content %) |
|---|---|---|---|---|---|
| Emulsion I | 4.3 | 0.45 | 25 | 1 | Core/shell = ⅓ (13/1), double structure grains |
| Emulsion II | 6.0 | 0.70 | 14 | 1 | Core/shell = 2/7 (25/2), double structure grains |
| Emulsion III | 8 | 0.75 | 30 | 2 | Core/shell = ½ (24/3), double structure grains |
| Emulsion IV | 4.3 | 1.08 | 35 | 2.5 | Core/shell = ½ (24/3), double structure grains |
| Emulsion V | 4.0 | 0.25 | 28 | 1 | Core/shell = ⅓ (13/1), double structure grains |
| Emulsion VI | 14.0 | 0.75 | 28 | 2.5 | Core/shell = ½ (42/0), double structure grains |
| Emulsion VII | 14.5 | 1.30 | 25 | 3 | Core/shell = 37/63 (34/3), double structure grains |
| Emulsion VIII | 1 | 0.07 | 15 | 1 | Uniform grains |

TABLE 3

| Sample No. | Emulsion | Average aspect ratio | Chemical sensitization | Sensitivity | Sensitivity (After bending) | Graininess |
|---|---|---|---|---|---|---|
| 201 (Comparative Example) | Em-1 | 11.2 | Gold-sulfur | 100 | 83 | 100 |
| 202 (Comparative Example) | 2 | 7.8 | Gold-sulfur | 91 | 74 | 98 |
| 203 (Comparative Example) | 3 | 3.1 | Gold-sulfur | 73 | 63 | 101 |
| 204 (Comparative Example) | 4 | 2.5 | Gold-sulfur | 69 | 67 | 98 |
| 205 (Present Invention) | 5 | 11.2 | Gold-sulfur-tellurium | 129 | 121 | 98 |
| 206 (Present Invention) | 6 | 7.8 | Gold-sulfur-tellurium | 122 | 118 | 96 |
| 207 (Present Invention) | 7 | 3.1 | Gold-sulfur-tellurium | 113 | 104 | 100 |
| 208 (Comparative Example) | 8 | 2.5 | Gold-sulfur-tellurium | 93 | 91 | 102 |

TABLE 4

| Sample No. | Emulsion | Average aspect ratio | Chemical sensitization | Sensitivity before bending | Sensitivity After bending | Graininess |
|---|---|---|---|---|---|---|
| 301 (Comparative Example) | Em-I1 | 7.9 | Gold-sulfur | 100 | 61 | 100 |
| 302 (Present Invention) | " | " | Gold-sulfur-tellurium | 140 | 127 | 103 |
| 303 (Comparative Example) | I2 | " | Gold-sulfur | 128 | 106 | 98 |
| 304 (Present Invention) | " | " | Gold-sulfur-tellurium | 162 | 158 | 97 |
| 305 (Comparative Example) | H1 | 5.9 | Gold-sulfur | 91 | 63 | 99 |
| 306 (Present Invention) | " | " | Gold-sulfur-tellurium | 136 | 125 | 99 |
| 307 (Comparative Example) | H2 | " | Gold-sulfur | 112 | 100 | 98 |
| 308 (Present Invention) | " | " | Gold-sulfur-tellurium | 151 | 149 | 98 |
| 309 (Comparative Example) | J1 | 3.8 | Gold-sulfur | 73 | 52 | 92 |
| 310 (Present Invention) | " | " | Gold-sulfur-tellurium | 124 | 112 | 95 |
| 311 (Comparative Example) | J2 | 3.8 | Gold-sulfur | 106 | 93 | 90 |
| 312 (Present Invention) | " | " | Gold-sulfur-tellurium | 141 | 137 | 91 |
| 313 (Comparative Example) | K1 | 2.7 | Gold-sulfur | 46 | 44 | 88 |
| 314 (Comparative Example) | " | " | Gold-sulfur-tellurium | 66 | 64 | 89 |
| 315 (Comparative Example) | K2 | " | Gold-sulfur | 83 | 81 | 82 |
| 316 (Comparative Example) | " | " | Gold-sulfur-tellurium | 99 | 97 | 80 |

What is claimed is:

1. A method of preparing a silver halide photographic light-sensitive material, comprising chemically sensitizing a silver halide emulsion containing tabular grains having an aspect ratio of 3 or more, which occupy at least 50% of the total projected area of all silver halide grains contained in the emulsion by subjecting said silver halide emulsion to tellurium sensitization in the presence of a compound which generates silver telluride at a temperature of 40° C. to 95° C., or at a pAg of 6 to 11, wherein said compound is represented by the following formula (I):

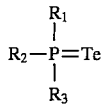

Formula (I)

where $R_1$, $R_2$, and $R_3$ represent aliphatic groups, aromatic groups, heterocyclic groups, $OR_4$, $NR_5(R_6)$, $SR_7$, $OSiR_8(R_9)(R_{10})$, $TeR_{11}$, X, or hydrogen atoms, $R_4$, $R_7$, and $R_{11}$ represent aliphatic groups, aromatic groups, heterocyclic groups, hydrogen atoms, or cations, $R_5$ and $R_6$ represent aliphatic groups, aromatic groups, heterocyclic groups, or hydrogen atoms, $R_8$, $R_9$, and $R_{10}$ represent aliphatic groups, and X represents a halogen atom.

2. The method of preparing the silver halide photographic light-sensitive material according to claim 1, wherein a tellurium sensitizer used in said tellurium sensitization is a compound which generates silver telluride at a temperature of 40° C. to 95° C. and at a pAg of 6 to 11 when reacted with a silver halide emulsion.

3. The method of preparing the silver halide photographic light-sensitive material according to claim 1, wherein a sulfur sensitizer is also used.

4. The method of preparing the silver halide photographic light-sensitive material according to claim 1, wherein a gold sensitizer is also used.

5. The method of preparing the silver halide photographic light-sensitive material according to claim 1, wherein said chemical sensitization is performed in the presence of thiocyanate.

6. The method of preparing the silver halide photographic light-sensitive material according to claim 1, wherein said chemical sensitization is performed in the presence of a spectral sensitizing dye.

7. The method of preparing the silver halide photographic light-sensitive material according to claim 6, wherein said spectral sensitizing dye is selected from the group consisting of a cyanine dye, a merocyanine dye, a hemicyanine dye, a styryl dye and a hemioxonol dye.

8. The method of preparing the silver halide photographic light-sensitive material according to claim 7, wherein said spectral sensitizing dye is selected from the group consisting of a composite cyanine dye, a composite merocyanine dye and a homopolar cyanine dye.

9. The method of preparing the silver halide photographic light-sensitive material of claim 1, wherein at least one of $R_1$, $R_2$, $R_3$, $R_4$, $R_5$, $R_6$, $R_7$ and $R_{11}$ is an aliphatic group containing 1 to 30 carbon atoms.

10. The method of preparing the silver halide photographic light-sensitive material of claim 1, wherein said material contains the compound of formula (I), wherein at least one of $R_1$, $R_2$, $R_3$, $R_4$, $R_5$, $R_6$, $R_7$ and $R_{11}$ is an aromatic group containing 6–20 carbon atoms, and further wherein said aromatic group is selected from the group consisting of a single ring or a condensed ring.

11. The method of preparing the silver halide photographic light-sensitive material of claim 1, wherein said material contains the compound of formula (I), wherein at least one of $R_1$, $R_2$, $R_3$, $R_4$, $R_5$, $R_6$, $R_7$ and $R_{11}$ is a heterocyclic group, wherein said heterocyclic group is selected from the group consisting of saturated heterocyclic groups containing 3 to 10 members and unsaturated heterocyclic groups containing 3 to 10 members.

12. The method of preparing the silver halide photographic light-sensitive material of claim 11, wherein said heterocyclic group has at least one atom selected from the group consisting of an oxygen atom, a nitrogen atom and a sulfur atom.

13. The method of preparing the silver halide photographic light-sensitive material of claim 12, wherein said heterocyclic group is selected from the group consisting of a pyridyl group, a furyl group, a thienyl group, a thiazolyl group, an imidazolyl group and a benzimidazolyl group.

14. A silver halide emulsion containing tabular grains having an aspect ratio of 3 or more, which occupy at least 50% of the total projected area of all silver halide grains contained in the emulsion, and having been subjected to tellurium sensitization in the presence of a compound which generates silver telluride at a temperature of 40° C. to 95° C., and at a pAg of 6 to 11, wherein said compound is represented by the following formula (I):

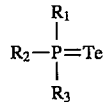

Formula (I)

where $R_1$, $R_2$, and $R_3$ represent aliphatic groups, aromatic groups, heterocyclic groups $OR_4$, $NR_5(R_6)$, $SR_7$, $OSiR_8(R_9)(R_{10})$, $TeR_{11}$, X, or hydrogen atoms, $R_4$, $R_7$, and $R_{11}$ represent aliphatic groups, aromatic groups, heterocyclic groups, hydrogen atoms, or cations, $R_5$ and $R_6$ represent aliphatic groups, aromatic groups, heterocyclic groups, or hydrogen atoms, $R_8$, $R_9$, and $R_{10}$ represent aliphatic groups, and X represents a halogen atom.

* * * * *

UNITED STATES PATENT AND TRADEMARK OFFICE

CERTIFICATE OF CORRECTION

PATENT NO. : 5,561,033

DATED : October 1, 1996

INVENTOR(S) : Y. KASHI et al.

It is certified that error appears in the above-indentified patent and that said Letters Patent is hereby corrected as shown below:

In the "(*) Notice:" section please change "Pat. No. 5,215,880" to --Pat. Nos. 5,395,745; 5,215,880; and 5,273,874--.

Signed and Sealed this

Twenty-first Day of April, 1998

Bruce Lehman

*Attest:*

BRUCE LEHMAN

*Attesting Officer*

*Commissioner of Patents and Trademarks*